US009206629B1

(12) United States Patent
Olschewsky et al.

(10) Patent No.: US 9,206,629 B1
(45) Date of Patent: Dec. 8, 2015

(54) GATE SECURING DEVICE FULLY CONTROLLABLE FROM EACH GATE SIDE AND METHOD THEREFOR

(71) Applicants: Eric Matthew Olschewsky, Frisco, TX (US); George Wayne Burkhardt, San Antonio, TX (US)

(72) Inventors: Eric Matthew Olschewsky, Frisco, TX (US); George Wayne Burkhardt, San Antonio, TX (US)

( * ) Notice: Subject to any disclaimer, the term of this patent is extended or adjusted under 35 U.S.C. 154(b) by 0 days.

(21) Appl. No.: 13/624,933

(22) Filed: Sep. 23, 2012

Related U.S. Application Data

(60) Provisional application No. 61/626,310, filed on Sep. 23, 2011.

(51) Int. Cl.
*E05C 19/10* (2006.01)
*E05C 3/14* (2006.01)

(52) U.S. Cl.
CPC ..... *E05C 3/145* (2013.01)

(58) Field of Classification Search
CPC ... E05B 65/0007; E05B 67/383; E05B 63/04; E05B 17/0033; E05B 67/24; E05B 15/0093; E05B 37/025; E05B 63/0065; E05B 65/0811; E05B 67/00; E05B 67/003; E05B 67/02; E05B 67/06; E05B 67/063; E05C 3/145
USPC ..... 292/124, 129, 132, 98, 99, 102, 240, 292/224, 234, 197, 198, DIG. 29
See application file for complete search history.

(56) References Cited

U.S. PATENT DOCUMENTS 1,951,158 A * 3/1934 Locke et al. ..... 206/315.5
3,988,031 A * 10/1976 Meyer ..... 292/153
4,178,025 A * 12/1979 Robins ..... 292/117
4,451,072 A * 5/1984 Petty, Sr. ..... 292/128
4,592,578 A * 6/1986 Martin ..... 292/40
4,741,564 A 5/1988 Alford
4,871,203 A 10/1989 Rogers
4,887,854 A * 12/1989 Bulten ..... 292/238
5,016,928 A * 5/1991 Segovia ..... 292/213
5,540,066 A * 7/1996 Takimoto ..... 70/99
6,471,261 B1 * 10/2002 Messler ..... 292/238
6,898,953 B1 5/2005 Paprocki
7,201,030 B2 4/2007 Timothy
2010/0148523 A1 * 6/2010 Tai ..... 292/236

OTHER PUBLICATIONS

LokkLatch® Deluxe, D&D Technologies, 7731 Woodwind Drive Huntington Beach, CA 92647, http://www.ddtechglobal.com/products/detail/lokklatch_deluxe.
The Ultimate Gate Latch, Perfect Products, Perfect Products 13941 South Hudson Ave Bixby, OK 74008-4081, http://www.doorsaver.com/ultimate-gate-latch.html.

* cited by examiner

*Primary Examiner* — Kristina Fulton
*Assistant Examiner* — Thomas Neubauer

(57) ABSTRACT

A device and method, for use with a striker bar to secure an object to an adjacent structure, the device operable from each side of the object. The device includes a latching member and a locking member. The latching member and the locking member are adapted for at least indirect mounting on the structure. The latching member has a leading edge cam and a grapple for engaging the striker bar to establish a latched state. The locking member has a closure portion and both pivots with and slides to engage with the latching mechanism. The members together include a multipart locking assembly operable alone or in combination with a separate lock device. The members secure the striker bar to the device when the members are locked together, thereby securing the object to the structure for establishment of a locked state.

17 Claims, 23 Drawing Sheets

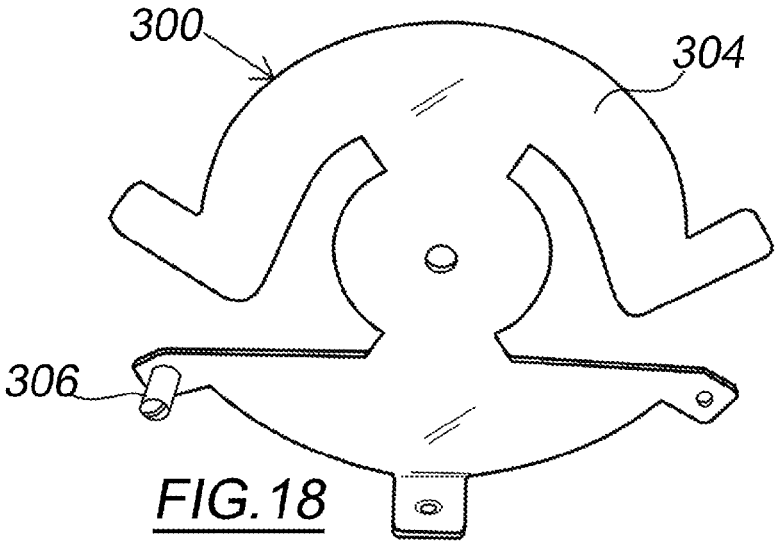
FIG.18
FIG.19
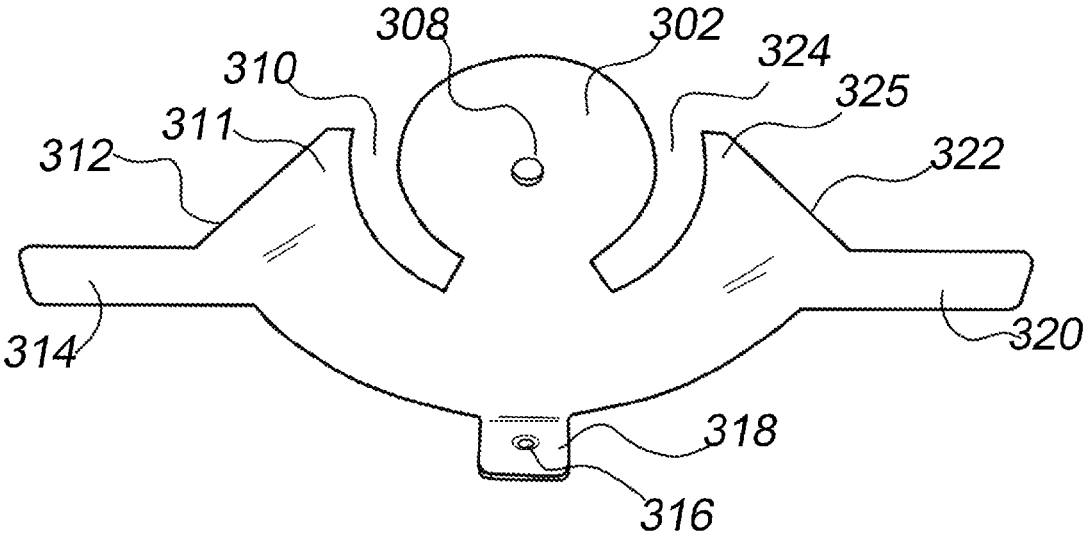

GATE SECURING DEVICE FULLY CONTROLLABLE FROM EACH GATE SIDE AND METHOD THEREFOR

CROSS-REFERENCE TO RELATED APPLICATIONS

This application claims the benefit of Provisional U.S. Patent Application Ser. No. 61/626,310, filed Sep. 23, 2011, by the present inventors.

FEDERALLY SPONSORED RESEARCH

None.

SEQUENCE LISTING

None.

BACKGROUND OF THE INVENTION

1. Field of Invention

This application relates to a gate securing device fully controllable from each gate side and method therefor and more specifically, to a securing device and method for a gate or other similar object that provides for locking with a single lock, unlocking, latching, and unlatching from each side of the gate or object.

2. Prior Art

In general, gates are installed to provide closure of a passage way which dictates the requirement for a device for securing the gate in a closed position. Most gate securing devices have mechanisms for latching, unlatching, locking and unlocking the gate in a closed position. Numerous gate securing devices have been designed and marketed that provide, in part, various degrees of latching, unlatching, locking and unlocking capabilities. Some gate securing devices are designed to only latch and unlatch a gate in which some of these can be controlled from each side of the gate. While other gate securing devices provide various degrees of latching, unlatching in combination with locking and unlocking, their parameters of operator control are limited.

U.S. Pat. No. 6,471,261 issued Oct. 29, 2002 to Thomas E. Messler discloses a latching apparatus in which a first connecting member is attached to a first attachment structure and a latching member is pivotally attached to a second connecting member and a second attachment structure. Insertion of securing mechanisms into a strategically position securing apertures prohibits disengagement and travel of a structure secured by the improved latching apparatus. Removal of either one of two said securing mechanisms from either side of a previously secured structure facilitates disengagement and travel of said previously secured structure. While this latching apparatus provides for latching, unlatching, locking and unlocking a gate, it has significant disadvantages, namely (1) the latch requires two locks, one on both sides of the gate, in order to secure the gate, (2) when the gate is secured, if operator wants to pass through the gate and re-secure the gate on the opposite side, a four step process is required to unsecure and then re-secure the gate, namely, (a) remove a near side lock and pass through gate, (b) remove a farside lock, (c) replace the nearside lock and close the gate and (d) replace the farside lock, (3) by simply unscrewing the fastening means, the latching apparatus can be disassembled while locked thus defeating the locked condition and (4) if the first connecting member of the gate latch has to be on a certain side of either a left or right hand gate then the latching apparatus may have to be disassembled, the second connecting member reversed and the latching apparatus reassembled.

U.S. Pat. No. 4,871,203 issued Oct. 3, 1989 to Gerald H. Rogers discloses a reversible mount gate latch with manual latch locking with includes a pivot latch member pivotally mounted on a latch mounting back plate mountable on a fence post or the middle end of the other half of a double gate with the pivot latch member and the back plate symmetrical for turn over mounting adaption to left hand opening and right hand opening gate sections. The striker bar receiving opening in the pivot latch member has a rear edge recessed back from the rear end of the striker bar receiving opening in the latch mounting back plate. The back plate has upper and lower striker bar entrance guide ramps and the pivot latch member has two entrance lifting ramps only one in use depending on right or left gate mounting by entrance of the striker bar. Pivot screw mounting thereof is limited by a limit screw engaging an end of an arcuate slot therein. A latched state manual lock structure is also provided with a "V" opening in a rear extension of the backing plate and a locking pin positioned along a slot in the pivot latch member moveable into and out of locking position in the "V" opening. While this gate latch provides for latching, unlatching, locking and unlocking a gate, it has significant disadvantages, namely (1) since the lock securing this gate latch cannot be made available to both sides of a gate, it limits the operator to unlock the gate only from its locked, side (2) the locking means on the gate latch opposite that of the striker bar side can be easily defeated by moving the locking pin to an unlocked position and (3) by simply unscrewing the pivot screw, the gate latch can be disassembled while locked thus defeating the locked condition.

U.S. Pat. No. 4,887,854 issued Dec. 19, 1989 to Paul J. Bulten discloses a gate support latch structure for use with either right-handed or left-handed gates. The latch includes a symmetrical main frame and keeper. The main frame has a striker receiving opening with two opposite cam surfaces flaring outwardly into a "Vee". A retainer stub is fixed to the main frame at a mid location at the inner end of the opening. A substantially flat keeper having a longitudinal axis has two opposite symmetrical striker receiving notches positioned at one end. The other end is pivotally connected at only one point to the main frame. The keeper may be sprung over the stub. While on one side of the retainer stub the keeper is for right handed gate and when it is on the other side it is for a left-handed gate. There are no springs and the weight of the keeper bar causes it to close over the striker. While this latching apparatus provides for latching, unlatching, locking and unlocking a gate, it has significant disadvantages, namely (1) since the lock securing this gate latch cannot be made available to both sides of a gate, it limits the operator to unlock the gate only from its locked side and (2) the locking means on the gate latch opposite that of the striker side can be easily defeated by moving a slip lock ring to a unlocked position.

U.S. Pat. No. 4,451,072 issued May 29, 1984 to William E. Petty discloses a gate latch provided for a stockade type fence. The latch may be opened from either side of the gate. Provisions are made whereby a padlock may be applied to the latch on either side of the gate. Means are provided for positively captivating the latch post carried by the gate to prevent the gate from being opened by merely forcing the latch post out of its associated slot in the latch. While this gate latch provides for latching, unlatching, locking and unlocking a gate, it has significant disadvantages, namely (1) since the lock securing this gate latch cannot be made available to both sides of a gate, it limits the operator to unlock the gate only from its locked side, (2) it requires a significant number of parts including at least one spring, (4) it is not self latching and (5) by simply removing the fastener 112, the gate latch can be disassembled while locked thus, defeating the locked condition.

U.S. Pat. No. 4,741,564 issued May 3, 1988 to Allen W. Alford discloses A double opening gate latch for single and double gates and capable of being unlocked and opened from either side thereof. First and second latch brackets are fixed to opposite ones of a gate and fence assembly or a double gate assembly, the latch brackets being positioned on opposite sides from one another. A latch bar is provided on one side of the gate assembly and is positioned for registry with a latch bracket. A pivotal latch member extends through the gate or fence assembly and includes a part that is pivotal into latching registry with the other latch bracket. The pivotal latch member is positionable in locking and unlocking relationship with the latch bar. The latch apparatus permits the gate to be unlatched from either side thereof and also permits the gate to be securely locked on either or both sides thereof. While this latching apparatus provides for latching, unlatching, locking and unlocking a gate, it has significant disadvantages, namely (1) the latch requires two locks, one on both sides of the gate, in order to secure the gate, (2) when the gate is secured, if operator wants to pass through the gate and remain on the opposite side, a four step process is required to unsecure and then resecure the gate, namely, (a) remove near side lock and pass through gate, (b) remove farside lock, (c) replace near-side lock and close the gate and (d) replace farside lock, (3) it requires a significant number of parts, (4) by simply removing bolts 22 or bolt and nut assembly 44, the gate latch can be disassembled while locked thus defeating the locked condition and (5) it is not self latching.

U.S. Pat. No. 6,898,953 issued May 31, 2005 to Benjamin J. Paprocki, Mark J. Knudson, and David M. Raschka discloses a locking gate latch includes a latch assembly and a striker bar. The striker bar is attached to a gate frame and the latch assembly is attached to a gate post. The latch assembly includes a latch frame, a lock latch, a locking plate and a locking tongue. The lock latch is pivotally retained by one leg of the latch frame. The locking plate is pivotally retained by the other leg of the latch frame. One end of the locking tongue is attached to an outside key lock and the other end is received by the locking plate. Pivoting the outside key lock to one side locks the locking gate latch. Pivoting the outside key lock to the other side unlocks the locking gate latch. A second embodiment of the gate latch further includes an inside locking assembly, which allows a gate to be locked from an inside. While this latching apparatus provides for latching, unlatching, locking and unlocking a gate, it has significant disadvantages, namely (1) installation requires a significant amount of modification to the gate latch mounting structure, (2) keyed lock(s) are integrated into gate latch mechanism which increases the cost, (3) gate latch mechanism is relatively complex, thereby increasing the cost and relative probability of malfunction and (3) to have a locking capability on each side of the gate, two locking mechanisms must be procured.

U.S. Pat. No. 7,201,030 issued Apr. 10, 2007 to E. Erik Timothy discloses a gate lock device with front and rear units to be mounted on opposite sides of a structure associated with the gate and against which the gate closes. A gravity latch, displaceably mounted in the housing of the front unit, is engageable with a keeper pin. The front and rear units are provided with key-operated locks which are operable to lock and unlock the gravity latch. The rear unit includes an axially displaceable actuator operable to unlock the gravity latch when the key-operated locks are unlocked. While this latching apparatus provides for latching, unlatching, locking and unlocking a gate, it has significant disadvantages, namely (1) installation requires thru holes to be made in the gate latch mounting structure, (2) gate latch mechanism is relatively complex, thereby increasing the cost and relative probability of malfunction and (3) to have a locking capability on each side of the gate, two locking mechanisms must be procured.

While these gate latches provide for latching, unlatching, locking and unlocking from either side of the gate, they all heretofore known suffer from deficiencies and drawbacks. Thus, there remains a need in the art for an inexpensive, easy to install, user friendly, and reliable gate securing device which provides for (1) the ability to control gate securing functions of locking with a single lock and unlocking from both sides of a gate, (2) the ability to control gate securing functions of latching and unlatching from both sides of a gate, (3) a gate securing device in which its attachment means cannot be removed when gate is in locked condition thus impacting security, (4) installation for both left and right hand gates, (5) self latching, (6) operator supplied lock and (7) gravity biased latching.

SUMMARY

A device and method, for use with a striker bar to secure an object, such as a panel, gate, door or other similar article to an adjacent structure, being fully controllable from each side of the object is disclosed. The device includes a latching member and a locking member. The latching member and the locking member are moveable at least one to the other. The members are adapted for at least indirect mounting on at least the structure. The latching member has a leading edge cam for guiding the latching member on the striker bar and a grapple for engaging with the striker bar to establish a latched state. The members each have at least one part of a multipart locking assembly. The multipart locking assembly provides for locking the members together in unison, either collectively or collectively in combination with a separate ancillary lock device. The members, in combination, are configured for securing the striker bar to the device when the members are locked together in unison, thereby securing the object to the structure for establishment of a locked state. The device is constructed and arranged for positioning said multipart assembly on each side of the object while the device is in one of the locked state and an unlocked state. Whereby, the object can be locked with either the multipart locking assembly or the multipart locking assembly in combination with the lock device, unlocked, latched and unlatched to and from the structure while accessing each side of the object.

Accordingly, the present invention may have one or more of the following advantages which are:

a. the ability to fully control gate securing functions of locking and unlocking from both sides of a gate with a single lock;

b. the ability to control gate securing functions of latching and unlatching from both sides of a gate;

c. a gate securing device which cannot be removed when gate is in a locked state thus ensuring security;

d. the capability to be installed on both left and right hand gates;

e. self latching;

f. uses only two moving parts on most embodiments g. provision for operator supplied lock;

h. gravity biased latching;

i. inexpensive;
j. easy to install; and
k. user friendly.

FIGURES

A better understanding of the embodiments of the gate securing device fully controllable from each gate side may be had by reference to the figures wherein:

FIG. 18 is a side perspective view showing a locking member assembly of the third embodiment of the gate securing device;

FIG. 19 is a side perspective view showing a latching member of the third embodiment of the gate securing device;

DETAILED DESCRIPTION OF THE EMBODIMENTS

This application relates to a gate, door or other similar article securing device fully controllable from each gate side and method therefor and more specifically to a gate securing device that can be latched, unlatched, locked, and unlocked from each side of the object or gate.

First Embodiment

FIG. 1, FIG. 2, FIG. 3, FIG. 4, FIG. 5, FIG. 6, FIG. 7, FIG. 8 and FIG. 9

Figure 1:
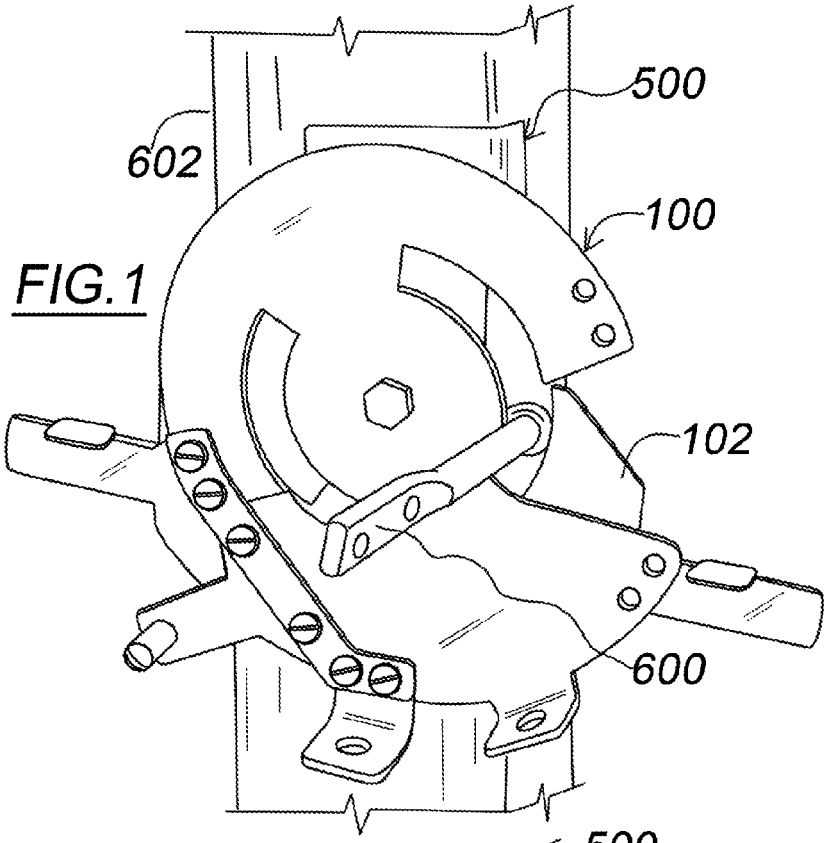
FIG. 1 is a side perspective view showing a first embodiment of the gate securing device installed and in a latched condition.

Referring to FIG. 1, a first embodiment of the gate securing device is shown. FIG. 1 is the side perspective view showing a first embodiment of the gate securing device installed on a gate post 602 for use with a right hand gate and in a latched condition with a striker bar 600. The first embodiment includes a locking member assembly 100, a latching member 102 and an attachment bracket assembly 500. The locking member assembly 100 includes a locking member 104, a handle bracket 116, a handle bracket attachment plate 114, a locking handle 180, a handle attachment screw 112 and handle bracket attachment plate 114 screws 106, 108, 110, 118, 120 and 122.

The locking member 104 has a left hand handle bracket 116 opening 156 and a right hand handle bracket 116 opening 170. Also, the locking member 104 has a left striker bar 600 open space 148 and a right striker bar 600 open space 178. Furthermore, the locking member 104 has a left hand grapple 154 and a right hand grapple 172. The left hand grapple 154 and the right hand grapple 172 provide an entrance in to open space 148 and 178, respectively.

The handle bracket attachment plate 114 includes holes 192 and 194 for attachment to the handle bracket 116, holes 188, 190, 196 and 198 for attachment to the locking member 104. The handle bracket 116 includes a threaded hole 184 and a threaded hole 186 for attachment to the handle bracket attachment plate 114 and a threaded hole 182 for attachment of the locking handle 180.

The handle bracket attachment plate 114 is attached to the handle bracket 116 by placing the screw 110 through hole 192, threading it into hole 184, placing the screw 118 through hole 194, threading it into hole 186. The locking handle 180 is attached to the handle bracket 116 by inserting the handle attachment screw 112 through the locking handle 180 and threading through hole 182. The locking member 104 includes threaded holes 150, 152, 158, 160, 166, 168, 174 and 176 for attachment of the handle bracket attachment plate 114. The gate securing device is designed for use with both right hand and left hand gates. If the gate securing device is used with a right hand gate then the handle bracket attachment plate 114 is attached on the left hand side of the locking member 104 using both the holes 188, 190, 196, 198, 150, 152, 158 and 160 and the screws 106, 108, 120 and 122. If the gate securing device is used with a left hand gate then the handle bracket attachment plate 114 is attached on the right hand side of the locking member 104 using both the holes 188, 190, 196, 198, 166, 168, 174 and 176 and the screws 106, 108, 120 and 122. When attaching the handle bracket attachment plate 114 to the locking member 104, the handle bracket 116 is inserted in the opening 156 or the opening 170 depending on whether the gate securing device is used with a left hand or right hand gate. The locking member 104 has a pivot hole 146 for attachment to the attachment bracket assembly 500. Also, the locking member 104 has a locking tab 162. The locking tab 162 has a lock aperture or keeper 164 for receiving a hasp of a lock 604.

The latching member 102 has a pivot hole 124 for attachment to attachment bracket assembly 500, a left handle 132, a right handle 138, a left striker bar 600 ramp or cam 128 and a right striker bar 600 ramp or cam 142. The latching member 102 also includes a lock tab 136. The lock tab 136 has a lock aperture or keeper 134 for receiving a hasp of the lock 604. The left handle 132 has a left locking tab 130. The right handle 138 has a right locking tab 140. The locking tabs 130 and 140 are used to provide alignment of the lock keeper 134 with the lock keeper 164 for insertion of the hasp of the lock 604. Additionally, the latching member 102 has a left hand grapple 127, a right hand grapple 143, a left striker bar 600 open space 126 and a right striker bar 600 open space 144. The right hand grapple 143 and the right striker bar 600 open space 144 are used for a right hand gate. The left hand grapple 127 and the left striker bar 600 open space 126 are used for a left hand gate.

Figure 9:
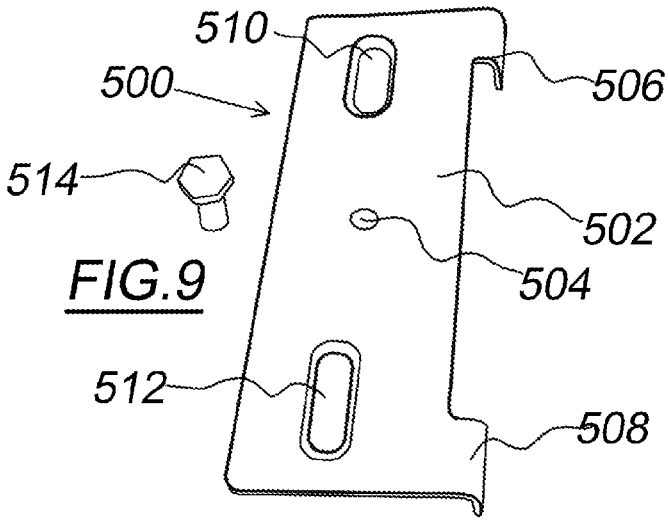
FIG. 9 is a side perspective view showing an attachment bracket assembly of the first embodiment of the gate securing device.

Referring to FIG. 9, a side perspective view showing an attachment bracket assembly of the first embodiment of the gate securing device is shown. The attachment bracket assembly 500 includes an attachment bracket 502 and a pivot fastener 514. The attachment bracket 502 includes an upper stop tab 506, a lower stop tab 508, an upper attachment slot 510, a lower attachment slot 512 and an attachment hole 504. The upper attachment slot 510 and the lower slot 512 are used for attachment with fasteners (not shown) to the gate post 602. The slots 510 and 512 are used for the attachment bracket 502 adjustment on the gate post 602. The upper stop tab 506 and lower stop tab 508 are used for alignment of the attachment bracket 502 to the side of the gate post 602. The locking member assembly 100 and the latching member 102 are attached to the attachment bracket 502 by inserting the pivot fastener 514 through the pivot holes 146 and 124, respectively with final securement, either removably or permanently, in attachment hole 504.

Figure 2:
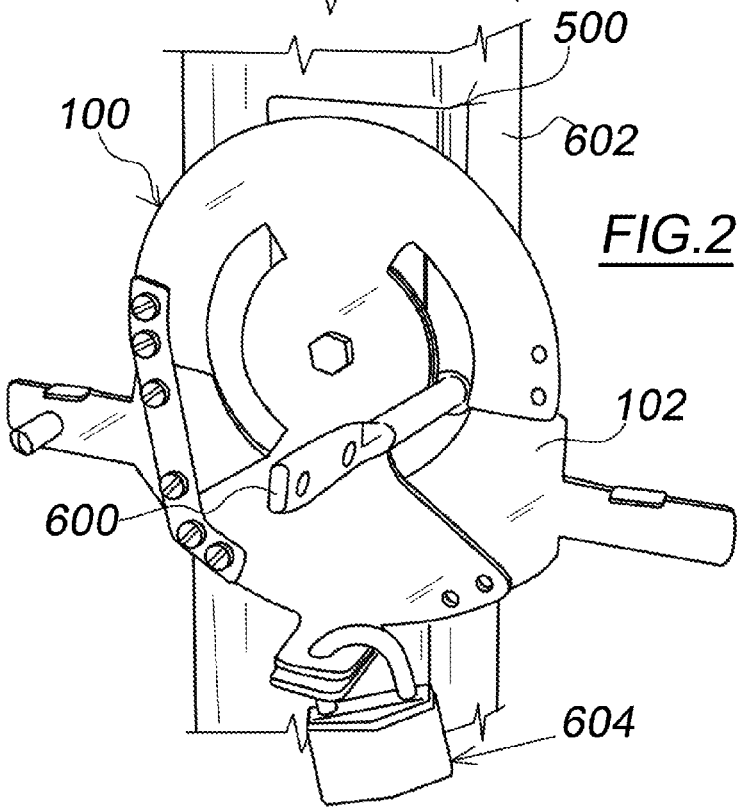
FIG. 2 is a side perspective view showing the first embodiment of the gate securing device installed and in a locked condition.
Figure 3:
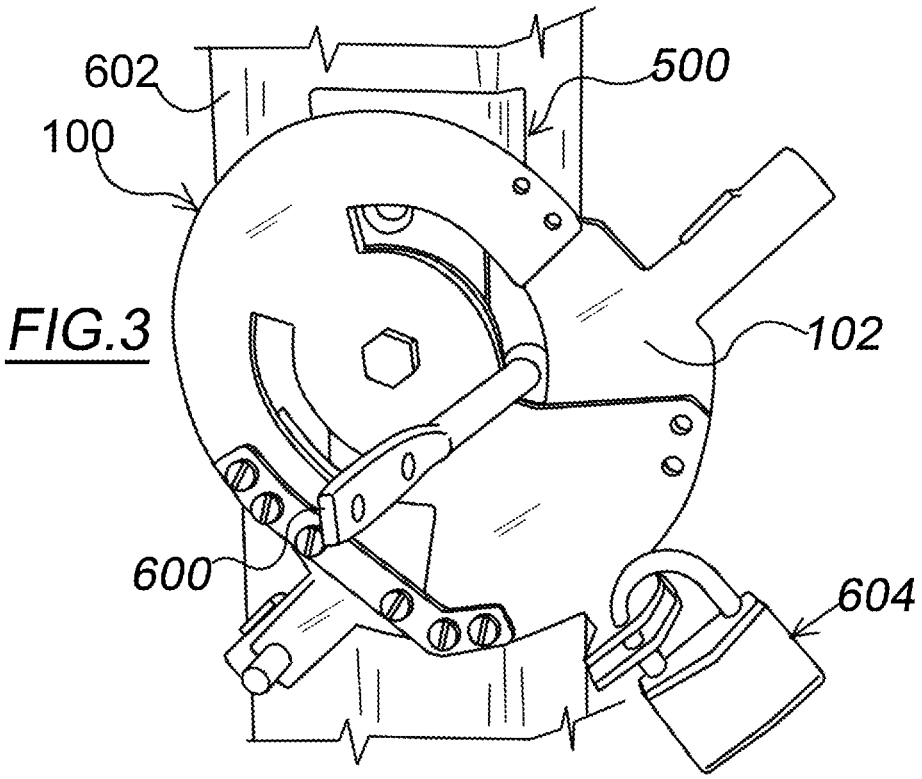
FIG. 3 is a side perspective view showing the first embodiment of the gate securing device installed and in a locked condition being rotated counterclockwise for operator accessibility to a lock.
Figure 4:
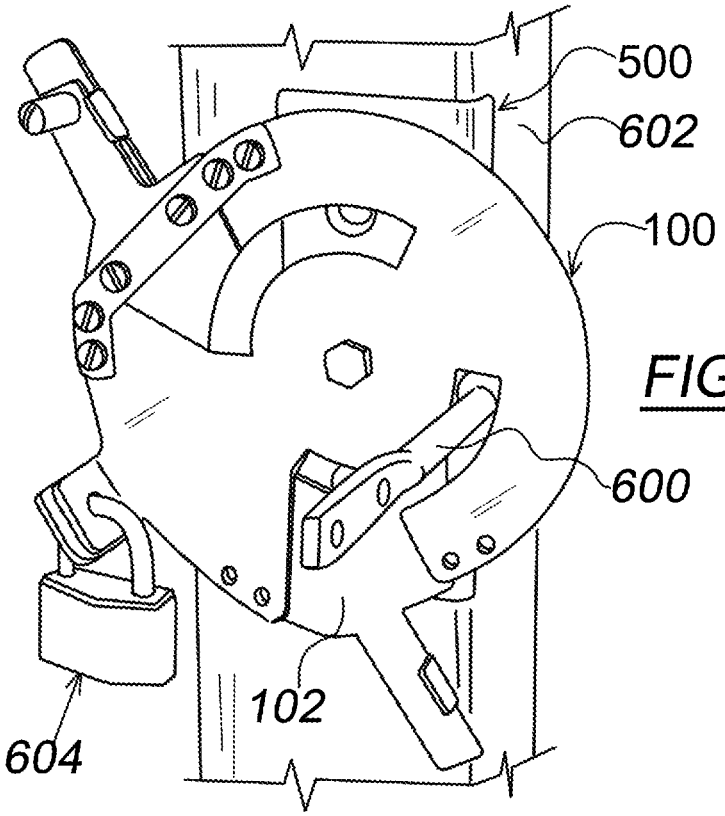
FIG. 4 is a side perspective view showing the first embodiment of the gate securing device installed and in a locked condition being rotated clockwise for operator accessibility to the lock.
Figure 5:
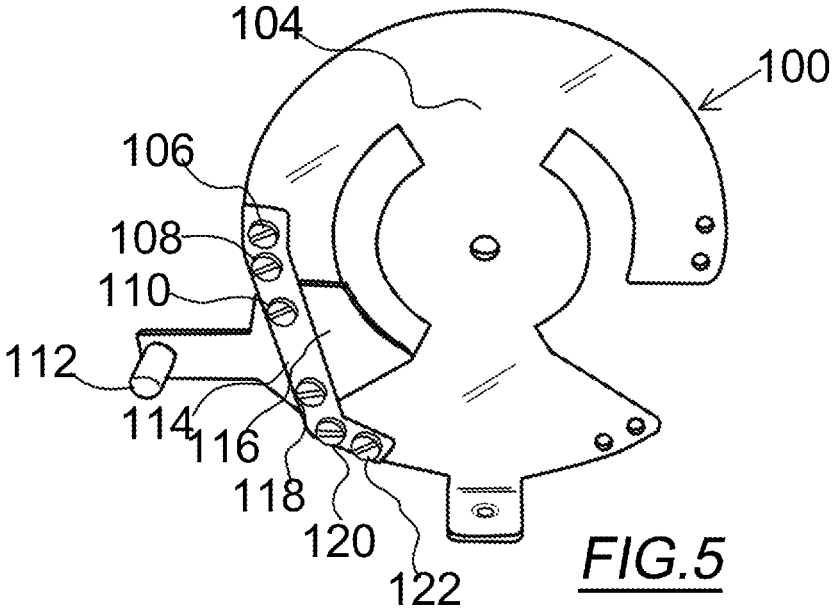
FIG. 5 is a side perspective view showing a locking member assembly of the first embodiment of the gate securing device.
Figure 6:
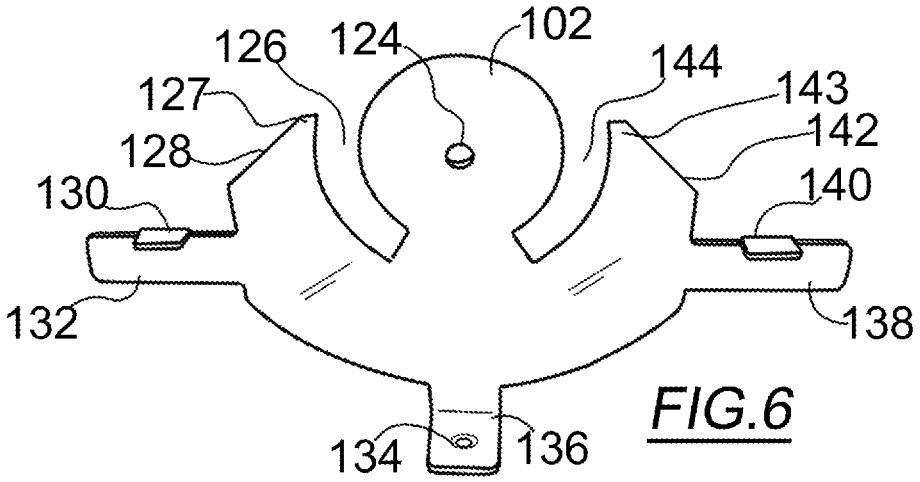
FIG. 6 is a side perspective view showing a latching member of the first embodiment of the gate securing device.
Figure 7:
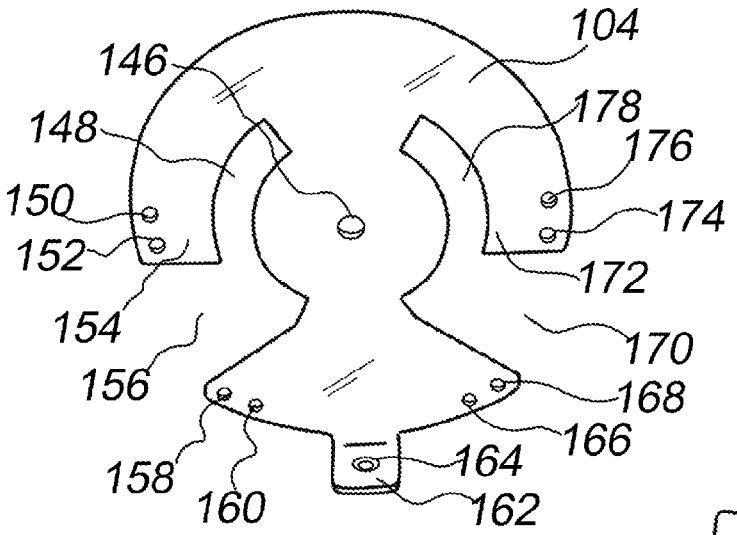
FIG. 7 is a side perspective view showing a locking member of the locking member assembly of the first embodiment of the gate securing device.
Figure 8:
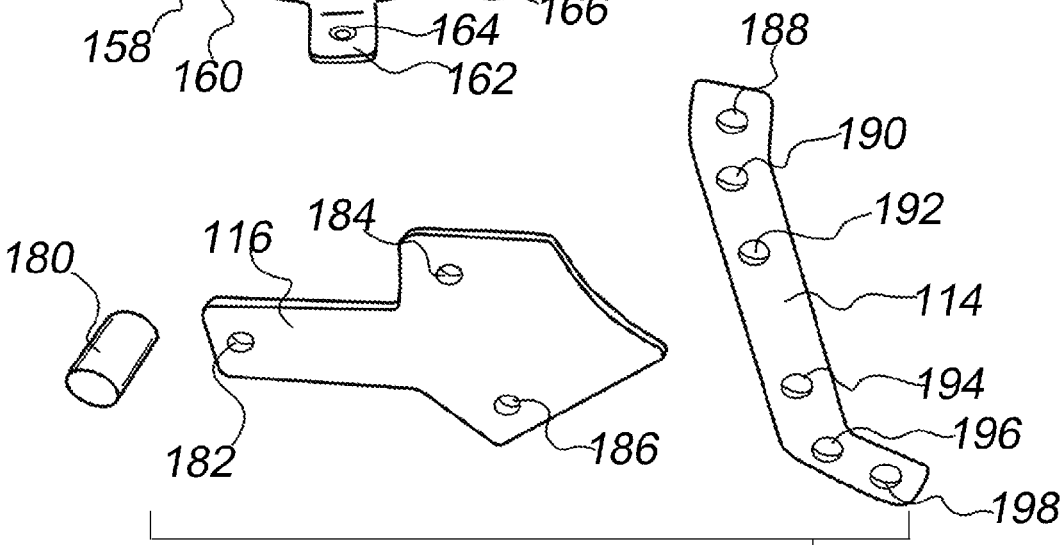
FIG. 8 is a side perspective view showing handle components of the locking member assembly of the first embodiment of the gate securing device.

For security enhancement, note the overlap of the right hand grapples 143 and 172 (the left hand grapples 127 and 154 when used with a left hand gate) when the latching member 102 is locked to the locking member assembly 100, as shown in FIGS. 2, 3 and 4.

Alternately and as a minimum, the first embodiment can include only the latching member 102 and the locking member 104 with a user supplied bolt/screw for attachment directly to the gate post 602 via holes 146 and 124.

For the purpose of this application, a gate is defined herein to include any vertically pivoted structure used for closure to a passage way for humans and/or animals, such as gates, doors, windows and the like. For the purpose of the first embodiment and all subsequent embodiments, the device applicable to the embodiment can be attached to either the gate post 602 or the gate and the striker bar 600 attached on the other of the gate post 602 and the gate.

Operation of the First Embodiment—FIG. 1, FIG. 2, FIG. 3 and FIG. 4

FIG. 1, FIG. 2, FIG. 3 and FIG. 4 show an example of the operation of the first embodiment applicable to a right hand gate. The operation of the gate securing device includes two sub-operations, namely a latching operation and a locking operation. To perform the latching operation, the following assumptions are made: the gate is open and the operator is on the striker bar 600 side of the gate. Upon closing the gate, the striker bar 600 interacts with cam 142 causing the latching member 102 to rotate clockwise (if a left hand gate is used, cam 128 has the same function as cam 142 but causes the latching member 102 to rotate counterclockwise). Then the striker bar 600 enters the right striker bar 600 opening 170 ending in the right striker bar 600 space 144 as a result of the latching member 102 rotating counterclockwise due to its inherent gravity bias (if a left hand gate is used, space 126 has the same function as space 144). The striker bar 600 is now secured by the right grapple 143 and thereby, resulting in the gate being in a latched state. To open the gate, it may be unlatched by applying a downward force to the right handle 138 causing the latching member 102 to rotate clockwise. The downward force is applied until the right grapple 143 is below the striker bar 600. At this point the gate is unlatched and can be opened.

If the operator is on the side of the gate opposite from the striker bar 600, the gate is latched in the same operation as previously stated except to open the gate, the left handle 132 is moved upward until the right grapple 143 is below the striker bar 600.

To perform the locking operation, the following assumptions are made: the gate is latched and the operator is on the striker bar 600 side of the gate. To lock the gate, the right handle 138 is moved upward until the left locking tab 130 engages the handle bracket 116 at which point the lock keepers 164 and 134 are aligned. The right handle 138 is moved further upward until the striker bar 600 is contacted at the termination of the open space 144. At this point the locking tabs 136 and 162 are at the maximum outward position away from the gate and closest to the operator. Now that the lock keepers 164 and 134 are aligned, the operator simply inserts the hasp of the lock 604 through lock keepers 164 and 134 to lock the gate. Upon release, the gravity bias returns the latching member 102 and the locking member assembly 100 to the point in which the lock 604 is in a full downward position.

When lock keepers 164 and 134 are locked together with lock 604, the latching member 102 and locking member 104 are secured together, thereby securing the striker bar 600 to either the right hand grapple 143, the right hand grapple 172 or in combination with both grapples 143 and 172, at the location where the grapples 143 and 172 overlap each other. The striker bar 600 remains secured to the grapples 143 and 172 as the latching member 102 and locking member 104 are rotated in unison.

If the operator is on the side of the gate opposite from the striker bar 600, the gate is locked in the same operation as previously stated except that the operator moves the locking handle 180 upwardly until the striker bar 600 is contacted at the termination of the open space 178, which moves the locking tabs 162 and 136 away from the gate and towards the operator where the operator simply locks the gate as described previously.

To unlock the gate, the right handle 138 is moved upwardly bringing the lock 604 away from the gate and towards the operator where the operator simply unlocks and removes the lock 604 and then releases the latching member 102 and the locking member assembly 100 where the gravity bias returns the latching member 102 and the locking member assembly 100 to their neutral balance position in a latched state. If the operator is on the side of the gate opposite from the striker bar 600, the gate is unlocked in the same operation as previously stated except that the operator moves the locking handle 180 upwardly bringing the lock 604 away from the gate and towards the operator where the operator simply unlocks the gate as described previously.

If a left hand gate is used, open spaces 148 and 126 have the same function as open spaces 178 and 144, respectively, when used as a right hand gate. Also, the left hand grapples 127 and 154 have the same function as the right hand grapples 143 and 172.

Second Embodiment

FIG. 9, FIG. 10, FIG. 11, FIG. 12, FIG. 13, FIG. 14, FIG. 15 and FIG. 16

Figure 10:
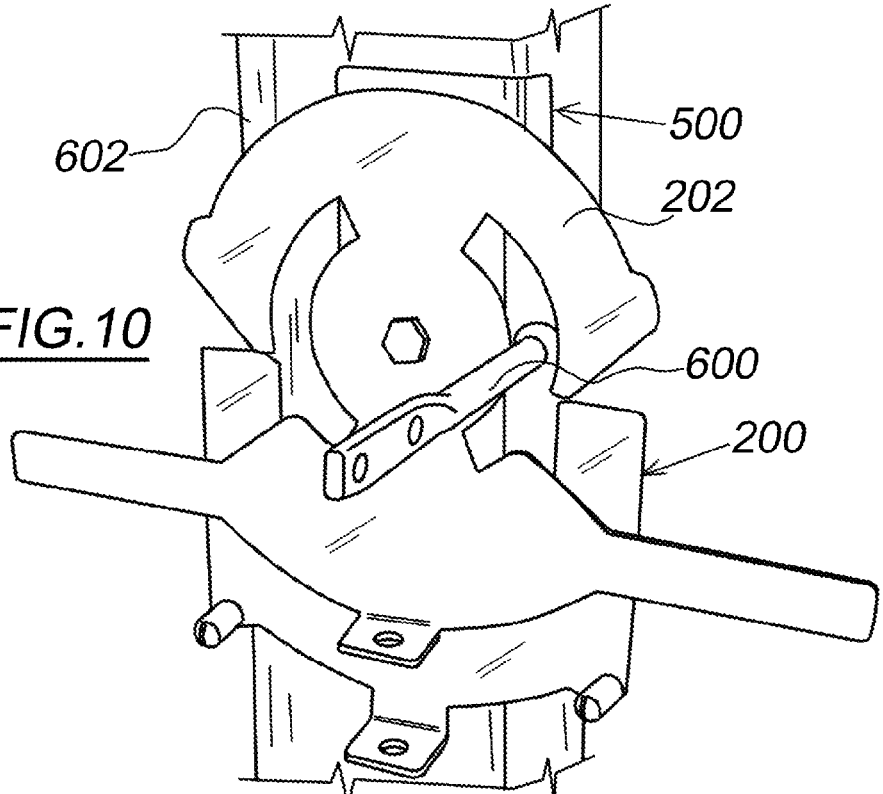
FIG. 10 is a side perspective view showing a second embodiment of the gate securing device installed and in a latched condition.

Referring to FIG. 10, a second embodiment of the gate securing device is shown. FIG. 10 is a side perspective view showing a second embodiment of the gate securing device installed on the gate post 602 for use with a right hand gate and in a latched condition with striker bar 600. The second embodiment includes a locking member assembly 200, a latching member 202 and the attachment bracket assembly 500.

The locking member assembly 200 includes a locking member 234, a left locking handle 246, a right locking handle 252, a handle attachment screw 236 and a handle attachment screw 238.

The locking member 234 includes a threaded hole 244 and a threaded hole 260 for attachment of the locking handles 246 and 252, respectively. The locking handles 246 and 252 are attached to the locking member 234 by inserting the handle attachment screws 236 and 238 through the locking handles 246 and 252, respectively and threading through holes 244 and 260, respectively. The locking member 234 has a slot 258. Also, the locking member 234 has a locking tab 250. The locking tab 250 has a lock aperture or keeper 248 for receiving the hasp of the lock 604. In addition, the locking member 234 has a left hand grapple 242, a right hand grapple 254, a left striker bar open space 240 and a right striker bar open space 256.

The latching member 202 has a pivot hole 204 for attachment to attachment bracket assembly 500, a left handle 214, a right handle 224, a left striker bar ramp or leading edge cam 208 and a right striker bar ramp or leading edge cam 230. The latching member 202 also includes a lock tab 220. The lock tab 220 has a lock aperture or keeper 218 for receiving the hasp of the lock 604. The left handle 214 has a left locking handle notch 216. The right handle 224 has a right locking handle notch 222. The notches 216 and 222 are used to receive the locking handles 246 and 252, respectively, and thereby providing alignment of the lock keeper 248 with the lock keeper 218. Additionally, the latching member 202 has a left hand grapple 212, a right hand grapple 226, a left striker bar open space 206 and a right striker bar open space 232. The left hand grapple 212 and the right hand grapple 226 are used to secure the striker bar 600. The locking member assembly 200 and the latching member 202 are attached to the attachment bracket 502 by inserting the pivot fastener 514 through the pivot hole 204 and the slot 258, respectively with final securement in attachment hole 504, either removable or permanently.

Figure 11:
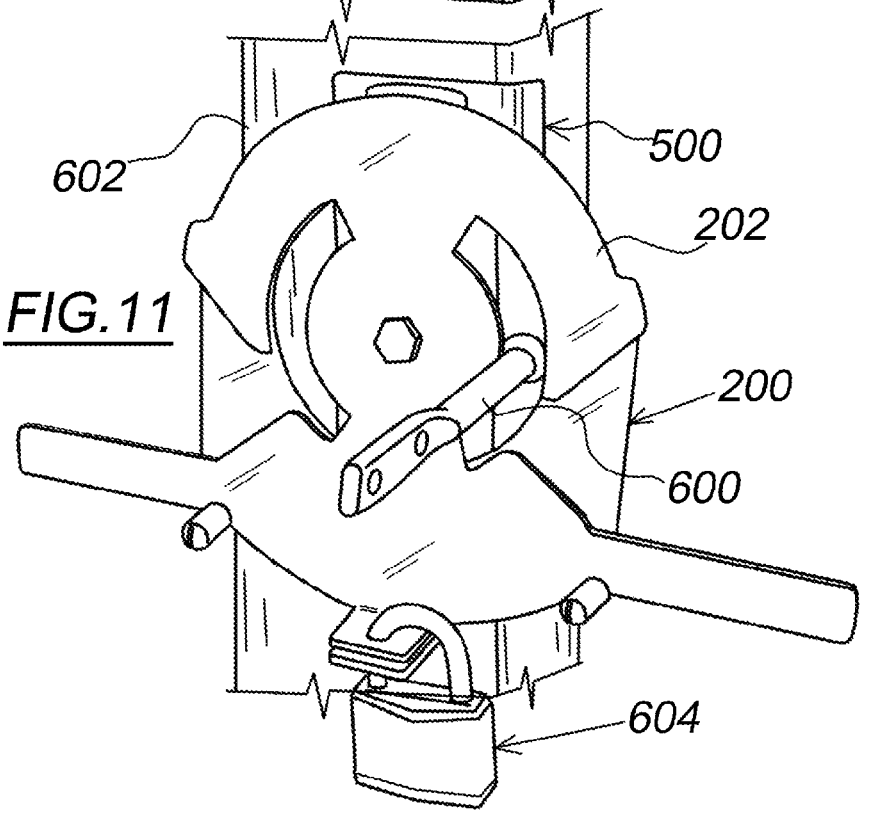
FIG. 11 is a side perspective view showing the second embodiment of the gate securing device installed and in a locked condition.
Figure 12:
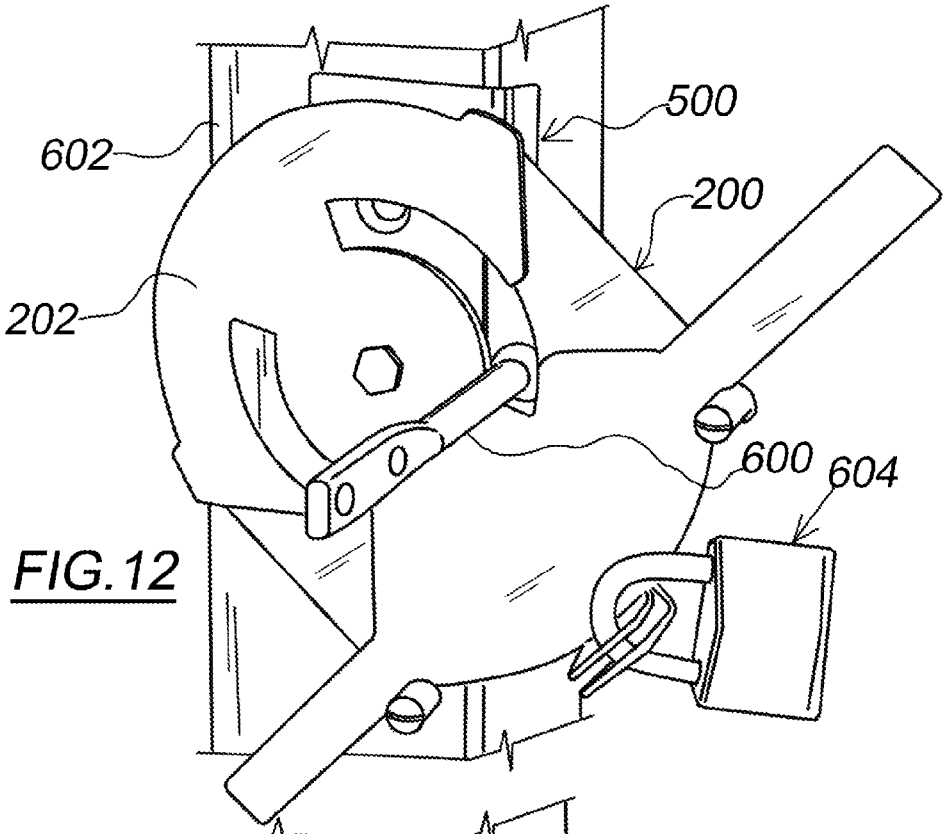
FIG. 12 is a side perspective view showing the second embodiment of the gate securing device installed and in a locked condition being rotated counterclockwise for operator accessibility to the lock.
Figure 13:
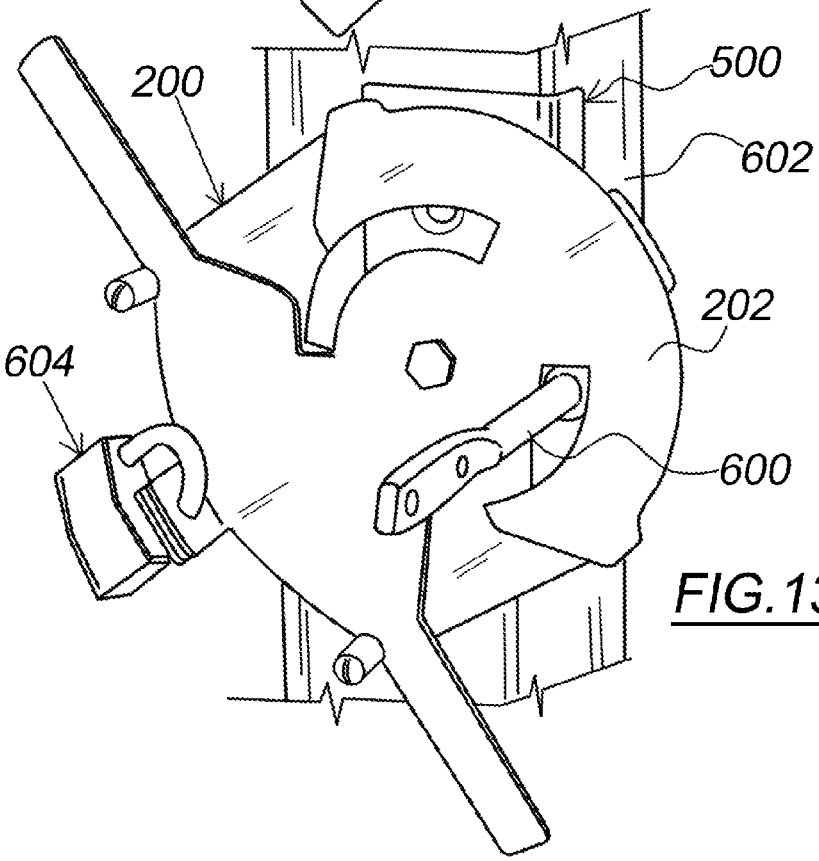
FIG. 13 is a side perspective view showing the second embodiment of the gate securing device installed and in a locked condition being rotated clockwise for operator accessibility to the lock.
Figure 14:
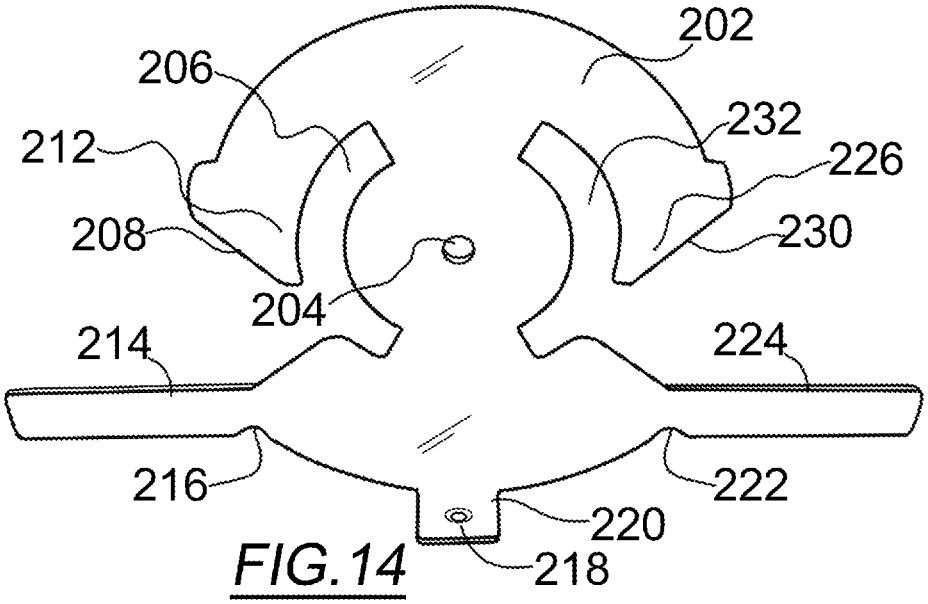
FIG. 14 is a side perspective view showing a latching member of the second embodiment of the gate securing device.
Figure 15:
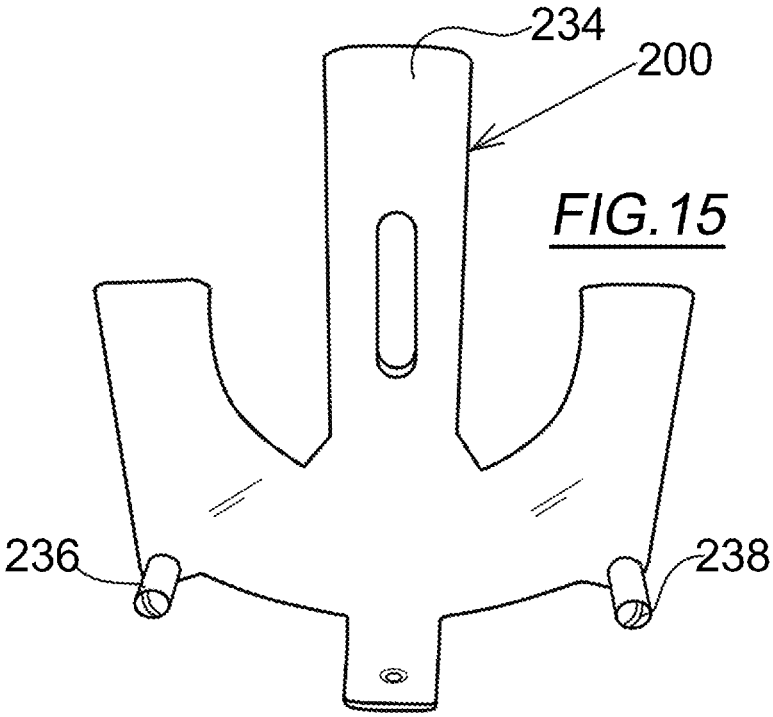
FIG. 15 is a side perspective view showing a locking member assembly of the second embodiment of the gate securing device.
Figure 16:
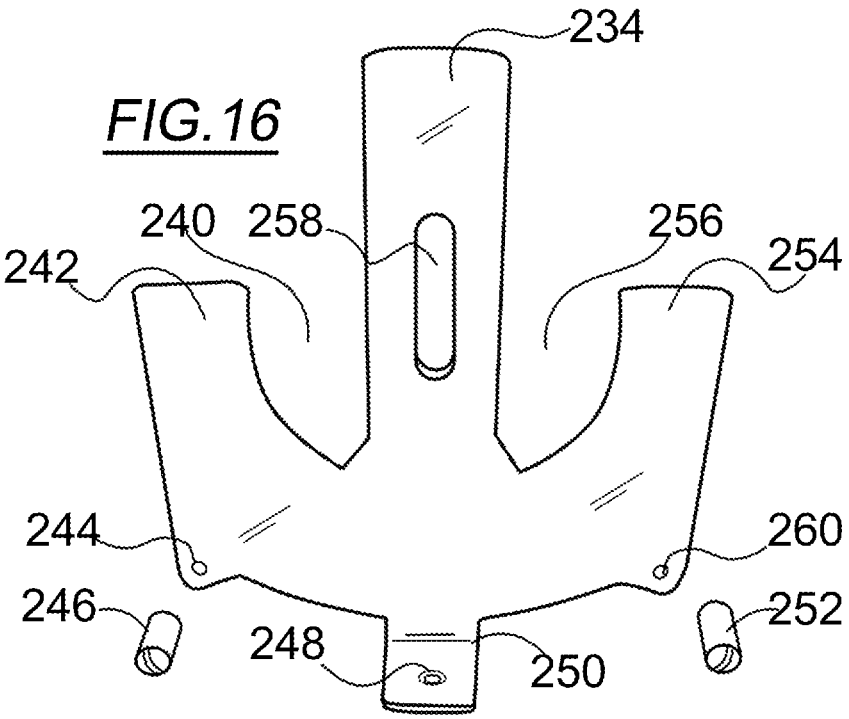
FIG. 16 is a side perspective view showing a locking member of the locking member assembly of the second embodiment of the gate securing device.

For security enhancement, note the overlap of the right hand grapples 226 and 254 (and the left hand grapples 212 and 242 when used with a left hand gate) when the latching member 202 is locked to locking member assembly 200, as shown in FIGS. 11, 12 and 13.

Alternately and as a minimum, the second embodiment can include only the latching member 202 and the locking member 234 with a user supplied bolt/screw for attachment directly to the gate post 602 via hole 204 and slot 258.

Operation of the Second Embodiment—FIG. 10, FIG. 11, FIG. 12 and FIG. 13

FIG. 10, FIG. 11, FIG. 12 and FIG. 13 show an example of the operation of the second embodiment applicable to a right hand gate. The operation of the gate securing device includes two sub-operations, namely a latching operation and a locking operation. To perform the latching operation, the following assumptions are made: the gate is open and the operator is on the striker bar 600 side of the gate. Upon closing the gate, the striker bar 600 interacts with leading edge cam 230, causing the latching member 202 to rotate counterclockwise (if a left hand gate is used, leading edge cam 208 has the same function as leading edge cam 230 but causes the latching member 202 to rotate clockwise), and then enters in the right striker bar 600 open space 232 as a result of the latching member 202 rotating clockwise due to its inherent gravity bias. The striker bar 600 is now secured by a first grapple 226 and thereby, resulting in the gate being in a latched position. To open the gate, it is unlatched by applying an upward force to the right handle 224 causing the latching member 202 to rotate counterclockwise. The upward force is applied until the right grapple 226 is above the striker bar 600. At this point the gate is unlatched and can be opened. If the operator is on the side of the gate opposite from the striker bar 600, the gate is latched in the same operation as previously stated except to open the gate, the left handle 214 is moved downward until the right grapple 226 is above the striker bar 600.

To perform the locking operation, the following assumptions are made: the gate is latched and the operator is on the striker bar 600 side of the gate. To lock the gate, the right locking handle 252 is moved upward until the right locking handle 252 contacts the right locking handle notch 222. At this point the lock keeper 248 is aligned and adjacent to lock keeper 218. The operator then moves the right locking handle 252 upwardly until the striker bar 600 is contacted at the termination of the open space 232. At this point locking tabs 220 and 250 are at the maximum outward position away from the gate and closest to the operator and together (with or without lock 604) form a multipart locking assembly. Since the lock keepers 218 and 248 are aligned and adjacent to each other, the operator simply inserts the hasp of the lock 604 through lock keepers 218 and 248 to lock the gate. Upon release, the gravity bias returns the latching member 202 and locking member assembly 200 to the point in which the lock 604 is in a full downward position.

If the operator is on the side of the gate opposite from the striker bar 600, the gate is locked in the same operation as previously stated except that the operator moves the locking handle 246 upwardly contacting the left locking handle notch 216 until the striker bar 600 is contacted at the termination of the open space 232, which moves the locking tabs 220 and 250 away from the gate and closest to the operator at which point the operator simply locks the gate as described previously.

When lock keepers 218 and 248 are locked together with lock 604, the latching member 202 and locking member 234 are secured together, thereby securing the striker bar 600 to either the right hand first grapple 226, the right hand second grapple 254 or in combination with both grapples 226 and 254, at the location where the grapples 226 and 254 overlap each other. The striker bar 600 remains secured to the grapples 226 and 254 as the latching member 202 and locking member 234 are rotated in unison.

To unlock the gate, the right locking handle 252 is moved upwardly bringing the lock 604 away from the gate and towards the operator where the operator simply unlocks and removes the lock 604 then releases the latching member 202 and locking member assembly 200 where the gravity bias returns the latching member 202 and the locking member assembly 200 to their neutral balance position in a latched state. If the operator is on the side of the gate opposite from the striker bar 600, the gate is unlocked in the same operation as previously stated except that the operator moves the locking handle 246 upwardly bringing the lock 604 away from the gate and towards the operator where the operator simply unlocks the gate as described previously.

If a left hand gate is used, open spaces 206 and 240 have the same function as open spaces 232 and 256, respectively, when used as a right hand gate. Also, the left hand grapples 212 and 242 have the same function as the right hand grapples 226 and 254.

Third Embodiment

FIG. 9, FIG. 17, FIG. 18, FIG. 19 and FIG. 20

Figure 17:
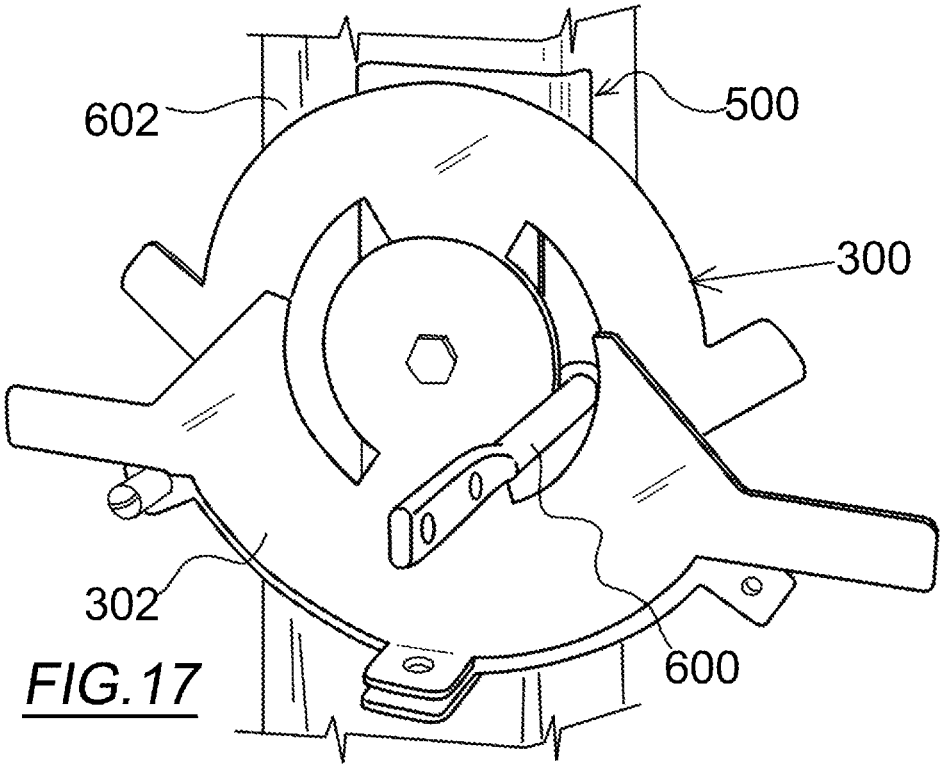
FIG. 17 is a side perspective view showing a third embodiment of the gate securing device installed and in a latched condition.
Figure 20:
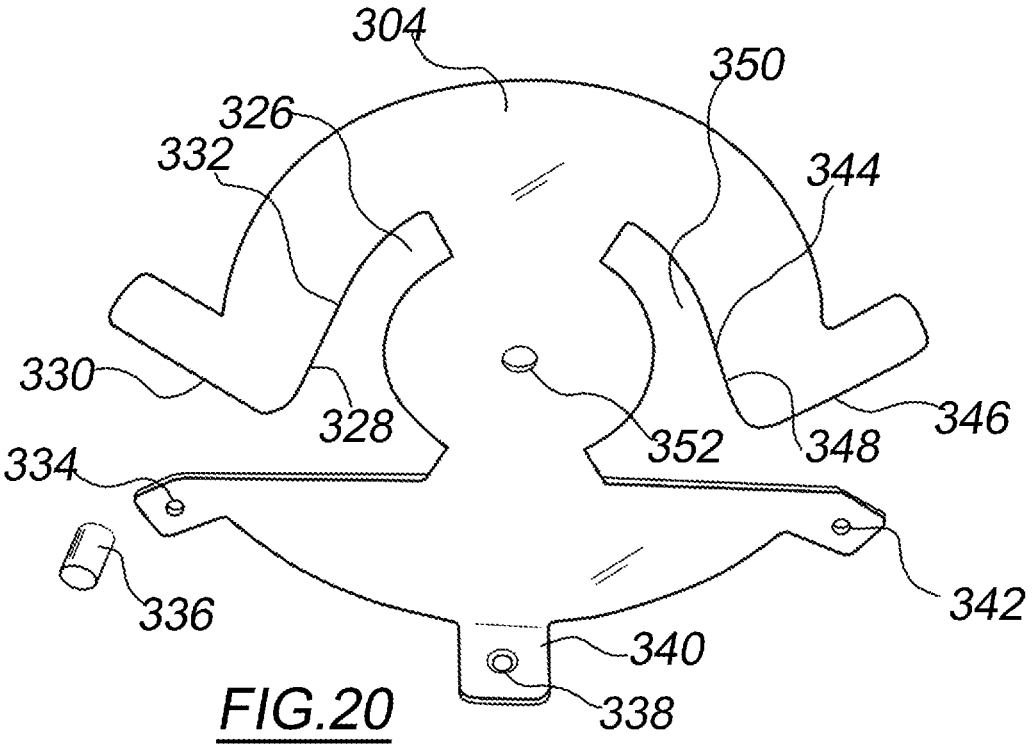
FIG. 20 is a side perspective view showing a locking member of the locking member assembly of the third embodiment of the gate securing device.

Referring to FIG. 17, a third embodiment of the gate securing device is shown. FIG. 17 is a side perspective view showing a third embodiment of the gate securing device installed on the gate post 602 for use with a right hand gate and in a latched condition with striker bar 600. The third embodiment includes a locking member assembly 300, a latching member 302 and the attachment bracket assembly 500. The locking member assembly 300 includes a locking member 304, a locking handle 336 and a handle attachment screw 306.

The locking member 304 has a left hand grapple 332 and a right hand grapple 344. Also, the locking member 304 has a left striker bar 600 open space 326 and a right striker bar 600 open space 350. Furthermore, the locking member 304 includes a threaded hole 334 and a threaded hole 342 for attachment of the locking handle 336. The locking handle 336 is attached to the locking member 304 by inserting the handle attachment screw 306 through the locking handle 336 and threading through applicable threaded holes 334 or 342 depending on use with a right hand or left hand gate. For use with a right hand gate, the locking handle 336 is attached by the handle attachment screw 306 through threaded hole 334. The locking member 304 has a pivot hole 352 for attachment to the attachment bracket assembly 500. Also, the locking member 304 has a locking tab 340. The locking tab 340 has a lock aperture or keeper 338 for use in the attachment of the hasp of the lock 604. In addition, the locking member 304 has a left striker bar 600 exit ramp or cam 328, a right striker bar 600 exit ramp or cam 348, a left striker bar 600 entrance ramp or cam 330 and a right striker bar 600 entrance ramp or cam 346.

The latching member 302 has a pivot hole 308 for attachment to attachment bracket 502, a left handle 314, a right handle 320, a left striker bar 600 ramp or cam 312 and a right striker bar 600 ramp or cam 322. The latching member 302 also includes a lock tab 318. The lock tab 318 has a lock aperture or keeper 316. Additionally, the latching member 302 has a left hand grapple 311, a right hand grapple 325, a left striker bar 600 open space 310 and a right striker bar 600 open space 324.

The locking member assembly 300 and the latching member 302 are attached to the attachment bracket 502 by inserting the pivot fastener 514 through the pivot holes 308 and 352, respectively with final securement in attachment hole 504, either removable or permanently.

For security enhancement, note the overlap of the right hand grapples 325 and 344 (and the left hand grapples 311 and 332 when used with a left hand gate) when the latching member 302 is locked to locking member assembly 300, similar to that as shown in FIGS. 11, 12 and 13.

Alternately and as a minimum, the third embodiment can include only the latching member 302 and the locking member 304 with a user supplied bolt/screw for attachment directly to the gate post 602 via holes 308 and 352.

Operation of the Third Embodiment—FIG. 17, FIG. 2, FIG. 3 and FIG. 4

FIG. 17, FIG. 2, FIG. 3 and FIG. 4 show an example of the operation of the third embodiment applicable to a right hand gate. The operation of the gate securing device includes two sub-operations, namely a latching operation and a locking operation. To perform the latching operation, the following assumptions are made: the gate is open and the operator is on the striker bar 600 side of the gate. Upon closing the gate, the striker bar 600 interacts with cams 346 and 322 causing the locking member assembly 300 to rotate counterclockwise and the latching member 302 to rotate clockwise (if a left hand gate is used, cams 330 and 312 have the same function as cams 346 and 322, respectively but cause the locking member assembly 300 to rotate clockwise and latching member 302 to rotate counterclockwise). Then the striker bar 600 enters the open spaces 324 and 350 as a result of the locking member assembly 300 rotating clockwise and the latching member 302 rotating counterclockwise due to their inherent gravity bias. The striker bar 600 is now secured by the grapple 325 and thereby, resulting in the gate being in a latched state.

To open the gate, it is unlatched by applying a downward force to the right handle 320 causing the latching member 302 to rotate clockwise. The downward force is applied until the right grapple 325 is below the striker bar 600. At this point the gate is unlatched and can be opened. When the striker bar 600 interacts with the right striker bar 600 exit cam 348, the locking member assembly 300 rotates counterclockwise so that the striker bar 600 can exit (if a left hand gate is used, exit cam 328 has the same function as exit cam 348 but causes the locking member assembly 300 to rotate clockwise).

If the operator is on the side of the gate opposite from the striker bar 600, the gate is latched in the same operation as previously stated except to open the gate, the left handle 314 is moved upwardly until the right grapple 325 is below the striker bar 600.

To perform the locking operation, the following assumptions are made: the gate is latched and the operator is on the striker bar 600 side of the gate. To lock the gate, the right handle 320 is moved upward until the left handle 314 contacts the locking handle 336 at which point the lock keepers 316 and 338 are aligned. The right handle 320 is moved further upward until the striker bar 600 is contacted at the termination of the open space 324. At this point the locking tabs 318 and 340 are at the maximum outward position away from the gate and closest to the operator. Now that the lock keepers 316 and 338 are aligned, the operator simply inserts the hasp of the lock 604 through lock keepers 316 and 338 to lock the gate. Upon release, the gravity bias returns the latching member 302 and locking member assembly 300 to their neutral position in a locked state.

If the operator is on the side of the gate opposite from the striker bar 600, the gate is locked in the same operation as previously stated except that the operator moves the locking handle 336 upwardly until the striker bar 600 is contacted at the termination of the open space 350, which moves the locking tabs 318 and 340 away from the gate and towards the operator where the operator simply locks the gate as described previously.

When lock keepers 316 and 338 are locked together with lock 604, the latching member 302 and locking member 304 are secured together, thereby securing the striker bar 600 to either the right hand grapple 325, the right hand grapple 344 or in combination with both grapples 325 and 344, at the location where the grapples 325 and 344 overlap each other. The striker bar 600 remains secured to the grapples 325 and 344 as the latching member 302 and locking member 304 are rotated in unison.

To unlock the gate, the right handle 320 is moved upwardly bringing the lock 604 away from the gate and towards the operator where the operator simply unlocks and removes the lock 604 then releases latching member 302 and locking member assembly 300 where the gravity bias returns the latching member 302 and locking member assembly 300 to their neutral position in a latched state. If the operator is on the side of the gate opposite from the striker bar 600, the gate is unlocked in the same operation as previously stated except that the operator moves the locking handle 336 upwardly moving the locking tabs 318 and 340 away from the gate and towards the operator where the operator simply unlocks the gate as described previously.

If a left hand gate is used, open spaces 310 and 326 have the same function as open spaces 324 and 350, respectively, when used as a right hand gate. Also, the left hand grapples 311 and 332 have the same function as the right hand grapples 325 and 344.

Fourth Embodiment

FIG. 9, FIG. 21, FIG. 22, FIG. 23, FIG. 24, FIG. 25, FIG. 26 and FIG. 27

Figure 21:
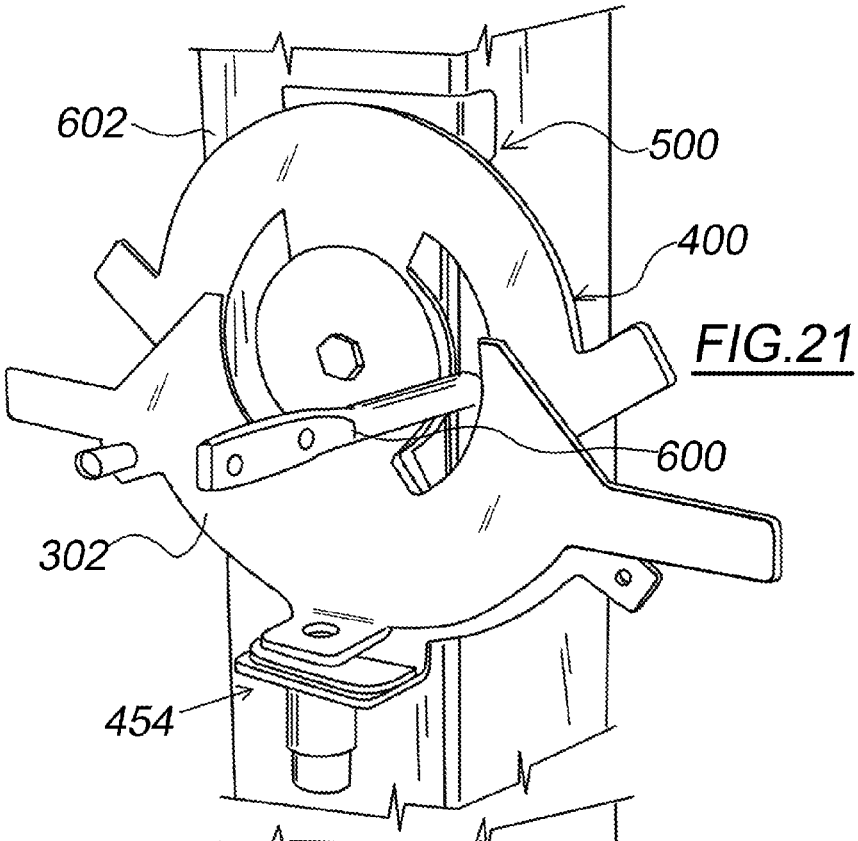
FIG. 21 is a side perspective view showing a fourth embodiment of the gate securing device installed and in a latched condition.
Figure 22:
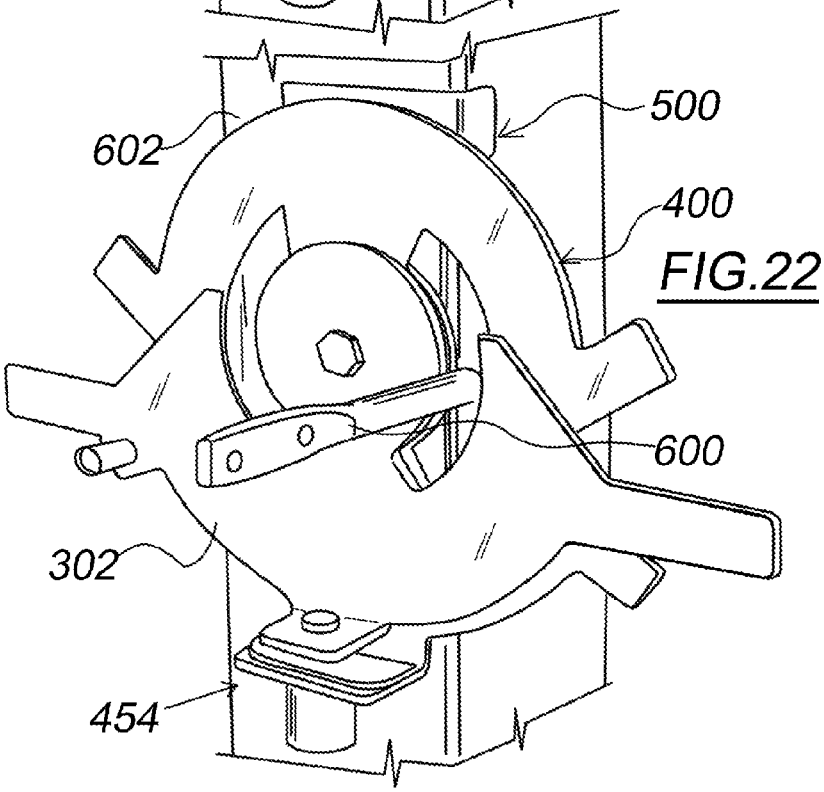
FIG. 22 is a side perspective view showing the fourth embodiment of the gate securing device installed and in a locked condition.
Figure 23:
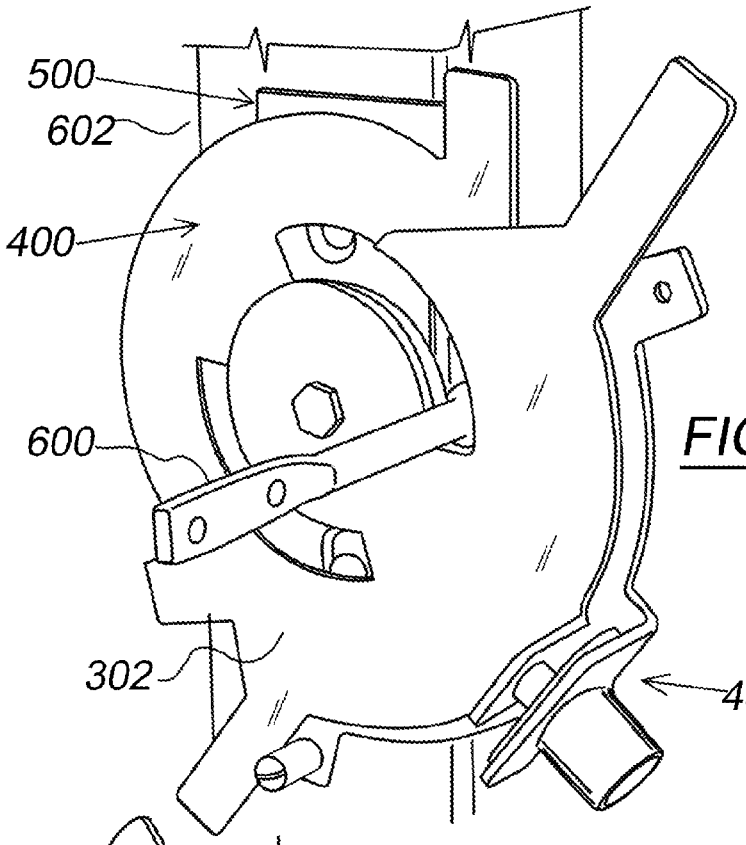
FIG. 23 is a side perspective view showing the fourth embodiment of the gate securing device installed and in a locked condition being rotated counterclockwise for operator accessibility to a locking mechanism.
Figure 24:
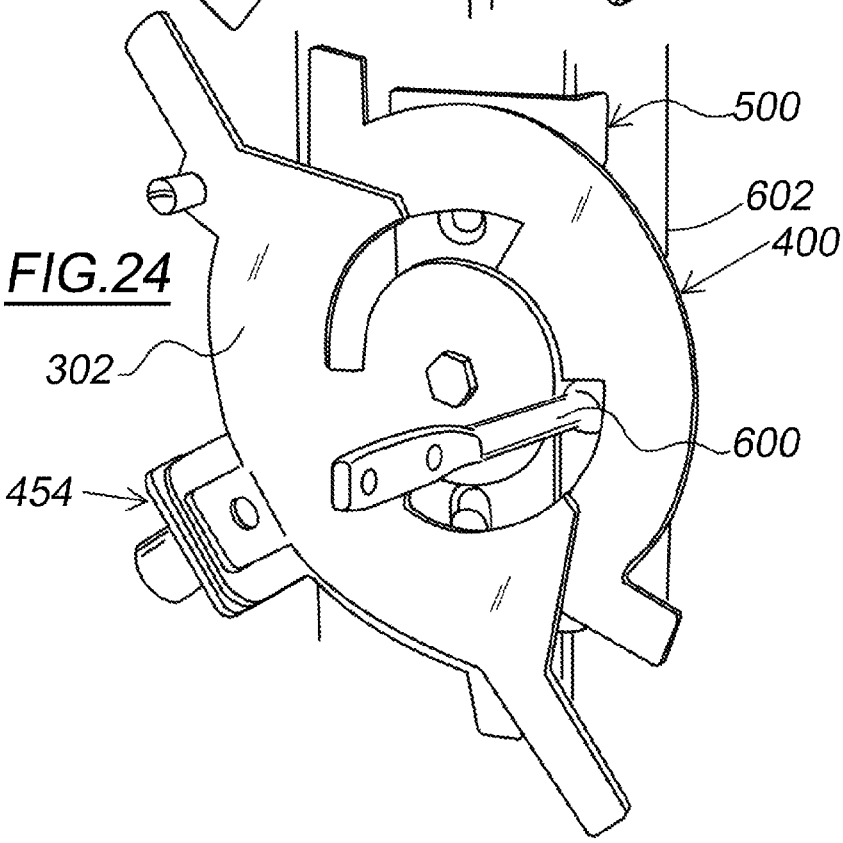
FIG. 24 is a side perspective view showing the fourth embodiment of the gate securing device installed and in a locked condition being rotated clockwise for operator accessibility a locking mechanism.
Figure 25:
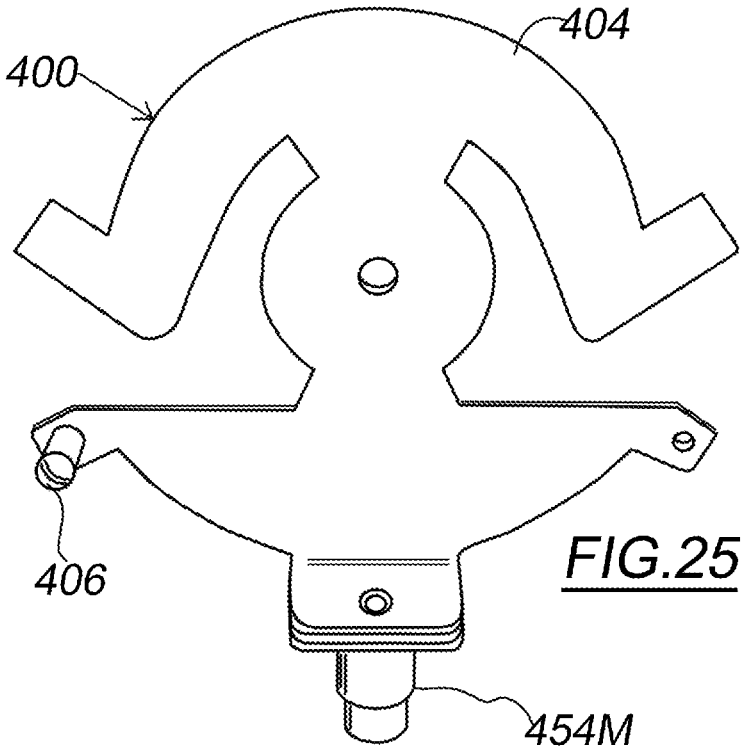
FIG. 25 is a side perspective view showing a locking member assembly of the fourth embodiment of the gate securing device.
Figure 26:
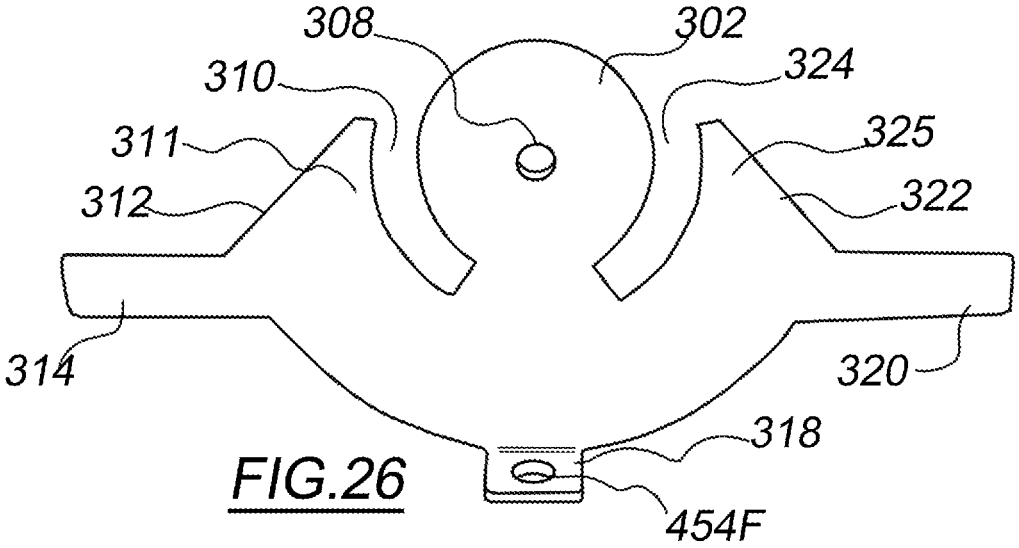
FIG. 26 is a side perspective view showing a latching member of the fourth embodiment of the gate securing device.
Figure 27:
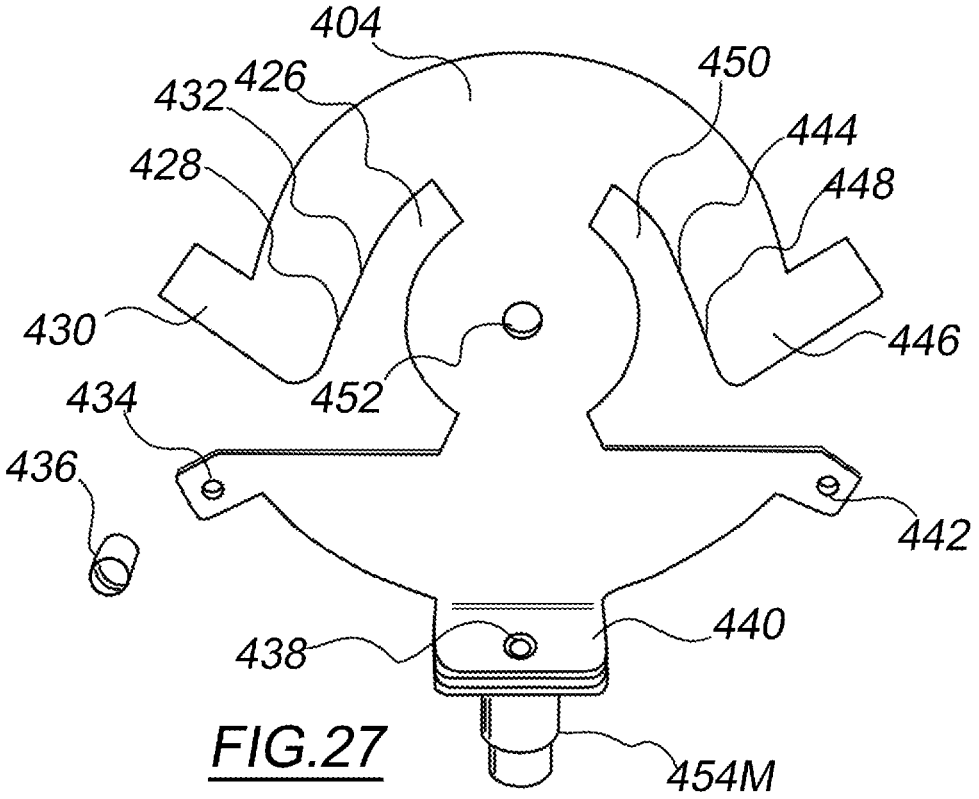
FIG. 27 is a side perspective view showing a locking member of the locking member assembly of the fourth embodiment of the gate securing device.

Referring to FIG. 21, a fourth embodiment of the gate securing device is shown. FIG. 21 is a side perspective view showing a fourth embodiment of the gate securing device installed on the gate post 602 for use with a right hand gate and in a latched condition with striker bar 600.

The fourth embodiment includes a locking member assembly 400, the same latching member 302 as the third embodiment, a locking mechanism assembly 454 and the attachment bracket assembly 500. The locking member assembly 400 is essentially the same as the locking member assembly 300 with one exception, namely a locking tab 440, which integrates a male portion 454M of the locking mechanism assembly 454. The female portion of the locking mechanism assembly 454 is a keeper 454F in the latching member 302. Therefore, other than these exceptions, the 400 series reference numbers applicable to the locking member assembly 400 of the fourth embodiment are the same as the corresponding 300 series reference numbers applicable to the locking member assembly 300 of the third embodiment (i.e. 430 is the same as 330). Additionally, other than these exceptions, the 400 series reference numbers applicable to the locking member assembly 400 of the fourth embodiment are the same as the function 300 series.

Since the locking member assembly 400 is the same as the locking member assembly 300 with an exception, only the exception will be described, herein, with further explanation being provided in the third embodiment. Also, since the fourth embodiment uses the same latching member 302 applicable to the third, further explanation can be obtained by reference to that description provided in the third embodiment.

The following provides a description of the exception applicable to the locking member assembly 400. The locking member 404 has the locking tab 440 which integrates the male portion 454M of the locking mechanism assembly 454.

The male portion 454M has an extendable locking pin 438. The remaining portion of the locking mechanism assembly 454 includes the keeper 454F in the latching member 302.

Alternately and as a minimum, the fourth embodiment can include only the latching member 302 and the locking member 404 with male portion 454M with a user supplied bolt/screw for attachment directly to the gate post 602 via holes 308 and 452.

Operation of the Fourth Embodiment—FIG. 21, FIG. 22, FIG. 23 and FIG. 24

FIG. 21, FIG. 22, FIG. 23 and FIG. 24 show an example of the operation of the fourth embodiment applicable to a right hand gate. The operation of the fourth embodiment is the same as that of the third embodiment with one exception. The exception being that the locking mechanism assembly 454 is used to lock the latching member 302 to the locking member assembly 400 in unison instead of the lock 604, used in the third embodiment. To lock the locking mechanism assembly 454, the locking tabs 318 and 440 are aligned in the same manner as described in the third embodiment. With this accomplished, the extendable locking pin 438 is engaged with the keeper 454F by activating the male portion 454.

To unlock the gate, the same operation as the third embodiment is used to bring the locking mechanism assembly 454 away from the gate and towards the operator where the operator simply unlocks the locking mechanism assembly 454 and the latching member 302 and locking member assembly 400 should return in a latched state.

Fifth Embodiment

FIG. 9, FIG. 28, FIG. 29, FIG. 30, FIG. 31, FIG. 32 and FIG. 33

Figure 28:
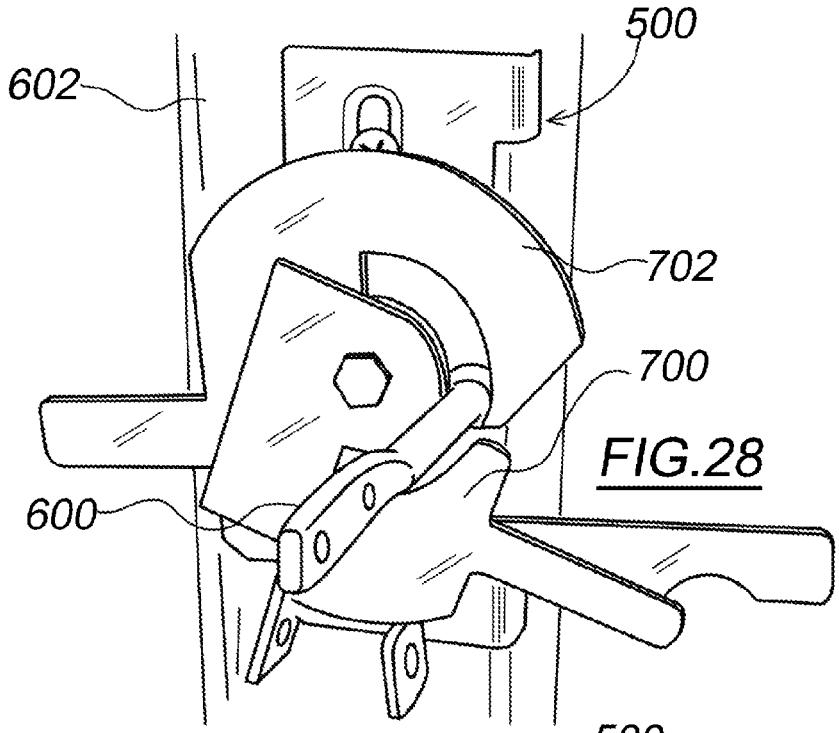
FIG. 28 is a side perspective view showing a fifth embodiment of the gate securing device installed and in a latched condition.

Referring to FIG. 28, a fifth embodiment of the gate securing device is shown. FIG. 28 is a side perspective view showing a fifth embodiment of the gate securing device installed on the gate post 602 for use with a right hand gate and in a latched condition with the striker bar 600. The fifth embodiment includes a locking member 734, a latching member 702 and the attachment bracket assembly 500.

Figure 33:
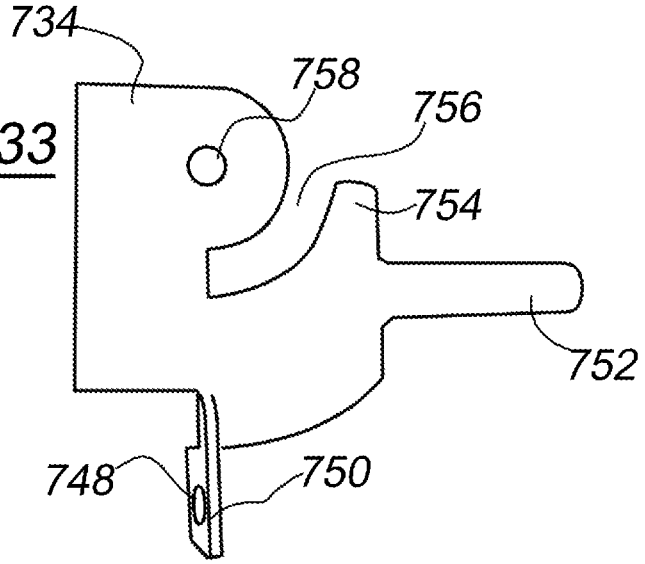
FIG. 33 is a side perspective view showing a locking member of the fifth embodiment of the gate securing device.

Referring to FIG. 33, the locking member 734 includes a locking handle 752, a pivot hole 758 and a locking tab 750. The locking tab 750 has a lock aperture or keeper 748 for receiving the hasp of the lock 604. In addition, the locking member 734 has a grapple 754 and a striker bar 600 open space 756.

Figure 32:
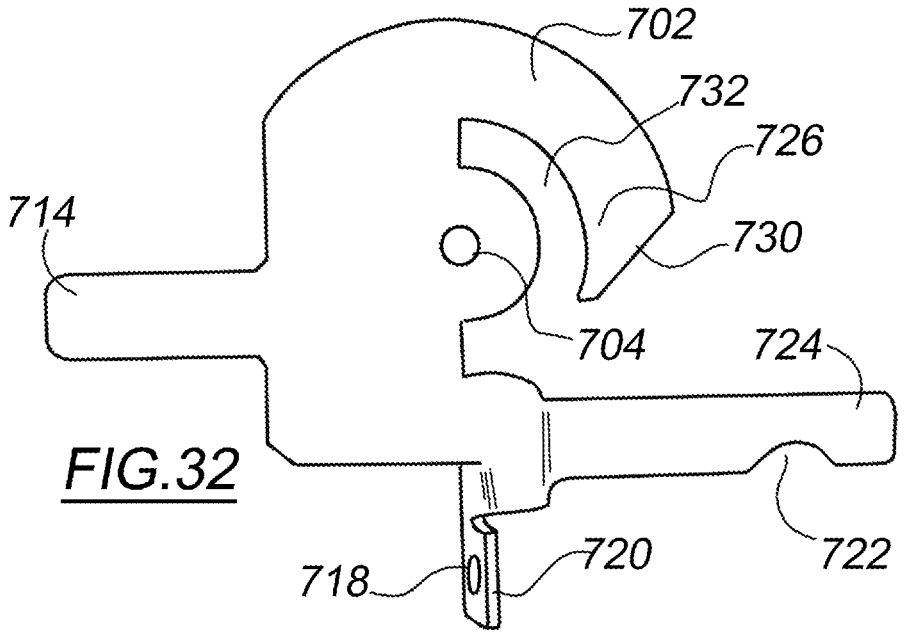
FIG. 32 is a side perspective view showing a latching member of the fifth embodiment of the gate securing device.

Referring to FIG. 32, the latching member 702 includes a pivot hole 704 for attachment to attachment bracket assembly 500, a left handle 714, a right handle 724 and a striker bar 600 ramp or cam 730. The right handle 724 has a handle notch 722. The latching member 702 also includes a lock tab 720. The lock tab 720 has a lock aperture or keeper 718 for receiving the hasp of the lock 604. The latching member 702 has a grapple 726 and a striker bar 600 open space 732. The grapple 726 is used to secure the striker bar 600 in a latched state.

The locking member 734 and the latching member 702 are attached to the attachment bracket 502 by inserting the pivot fastener 514 through the pivot hole 758 and pivot hole 704, respectively with final securement in attachment hole 504. Since latching member 702 and locking member 734 are not mirrored about a vertical line passing through holes 704 and 758, respectively, as are the latching and locking members in the first, second, third and fourth embodiments, the latching member 704 and locking member 734 cannot be permanently attached to attachment bracket 500 with pivot fastener 514 because latching member 704 and locking member 734 have to be reversed on bracket 500 for compatibility with left and right hand gates.

Figure 29:
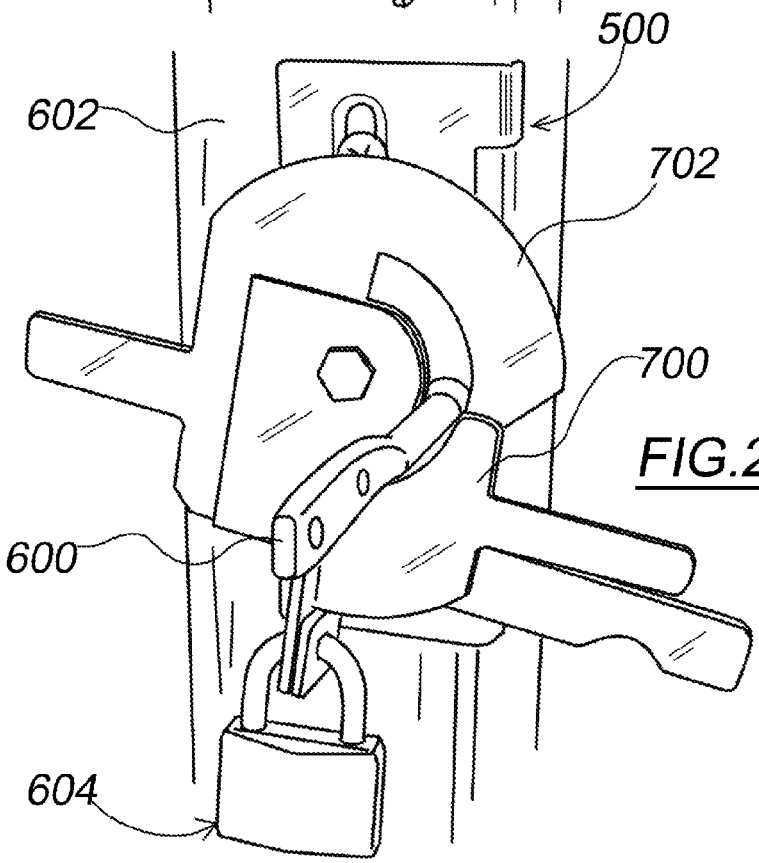
FIG. 29 is a side perspective view showing the fifth embodiment of the gate securing device installed and in a locked condition.
Figure 30:
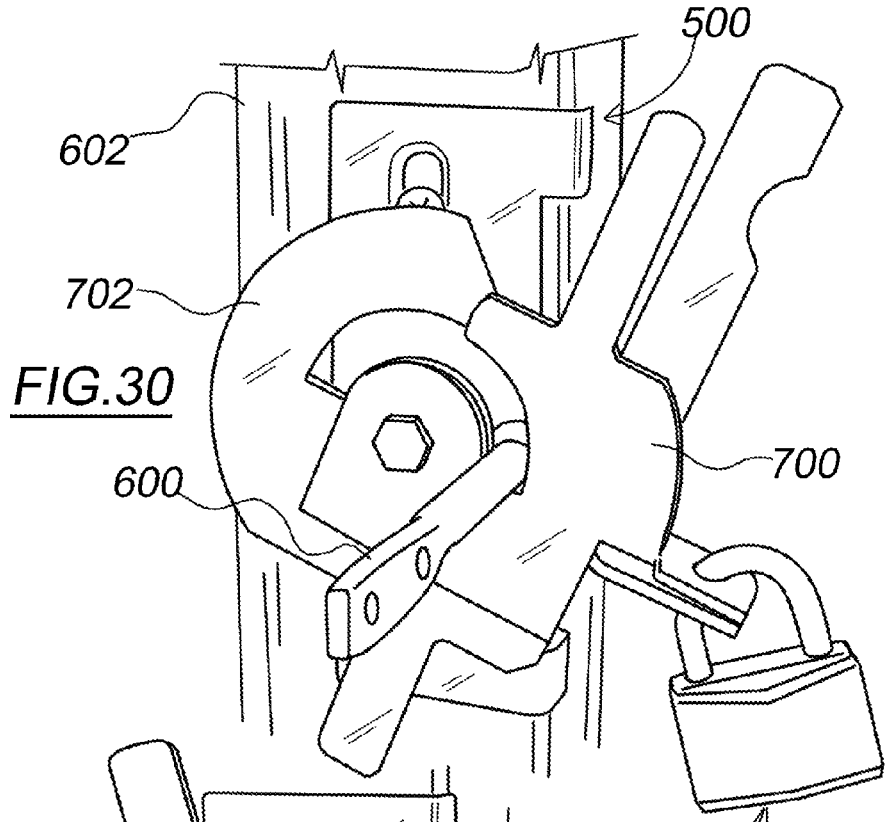
FIG. 30 is a side perspective view showing the fifth embodiment of the gate securing device installed and in a locked condition being rotated counterclockwise for operator accessibility to the lock.
Figure 31:
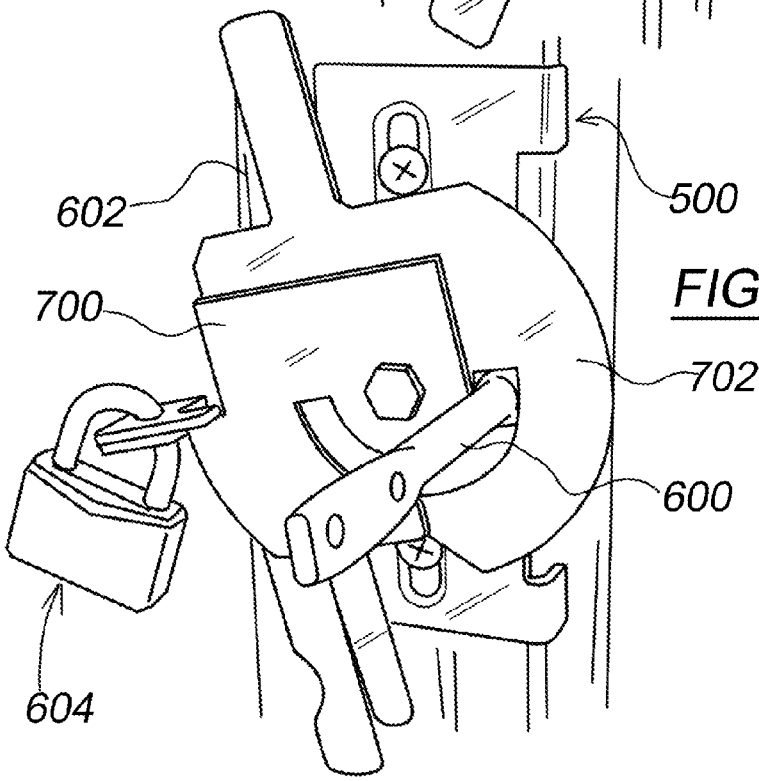
FIG. 31 is a side perspective view showing the fifth embodiment of the gate securing device installed and in a locked condition being rotated clockwise for operator accessibility to the lock.

For security enhancement, note the overlap of the grapples 726 and 754 when the latching member 702 is locked to locking member 734, as shown in FIGS. 29, 30 and 31.

Alternately and as a minimum, the fifth embodiment can include only the latching member 702 and the locking member 734 with a user supplied bolt/screw for attachment directly to the gate post 602 via holes 704 and 758.

Operation of the Fifth Embodiment—FIG. 28, FIG. 29, FIG. 30 and FIG. 31

FIG. 28, FIG. 29, FIG. 30 and FIG. 31 show an example of the operation of the fifth embodiment applicable to a right hand gate. The operation of the gate securing device includes two sub-operations, namely a latching operation and a locking operation. To perform the latching operation, the following assumptions are made: the gate is open and the operator is on the striker bar 600 side of the gate. Upon closing the gate, the striker bar 600 interacts with cam 730, causing the latching member 702 to rotate counterclockwise, and enter the striker bar 600 open space 732 as a result of the latching member 702 rotating clockwise due to its inherent gravity bias. The striker bar 600 is now secured by grapple 726 and thereby, resulting in the gate being in a latched position. To open the gate, it is unlatched by applying an upward force to the right handle 724 possibly using the handle notch 722 causing the latching member 702 to rotate counterclockwise. The upward force is applied until the grapple 726 is above the striker bar 600. At this point, the gate is unlatched and can be opened. If the operator is on the side of the gate opposite from the striker bar 600, the gate is latched in the same operation as previously stated except to open the gate, the left handle 714 is moved downward until the grapple 726 is above the striker bar 600.

To perform the locking operation, the following assumptions are made: the gate is latched and the operator is on the striker bar 600 side of the gate. To lock the gate the locking handle 752 is moved upward until the locking tab 750 contacts the locking tab 720. At this point, the lock keeper 748 is aligned and adjacent to lock keeper 718. The operator then moves the locking handle 752 upwardly until the striker bar 600 is contacted at the termination of the open space 756. At this point, locking tabs 720 and 750 are at the maximum outward position away from the gate and closest to the operator. Since the lock keepers 718 and 748 are aligned and adjacent to each other, the operator simply inserts the hasp of the lock 604 through the lock keepers 718 and 748 to lock the gate. Upon release, the gravity bias returns the latching member 702 and locking member 734 to the point in which the lock 604 is in a full downward or neutral position.

If the operator is on the side of the gate opposite from the striker bar 600, the gate is locked in the same operation as previously stated except that the operator moves the left handle 714 upwardly until the striker bar 600 is contacted at the termination of the open space 732, which moves the locking tabs 720 and 750 away from the gate and closest to the operator at which point the operator simply locks the gate as described previously.

When lock keepers 718 and 748 are locked together with lock 604, the latching member 702 and locking member 734 are secured together, thereby securing the striker bar 600 to either the grapple 726, the grapple 754 or in combination with both grapples 726 and 754, at the location where the grapples 726 and 754 overlap each other. The striker bar 600 remains secured to the grapples 726 and 754 as the latching member 702 and locking member 734 are rotated in unison.

To unlock the gate, the right handle 724 is moved upwardly bringing the lock 604 away from the gate and towards the operator where the operator simply unlocks and removes the lock 604 then releases the latching member 702 and locking member 734 where the gravity bias returns the latching member 702 and the locking member 734 to their neutral balance position in a latched state. If the operator is on the side of the gate opposite from the striker bar 600, the gate is unlocked in the same operation as previously stated except that the operator moves the left handle 714 upwardly bringing the lock 604 away from the gate and towards the operator where the operator simply unlocks the gate as described previously.

Sixth Embodiment

FIG. 34, FIG. 35, FIG. 36, FIG. 37, FIG. 38, FIG. 39 and FIG. 40

Figure 34:
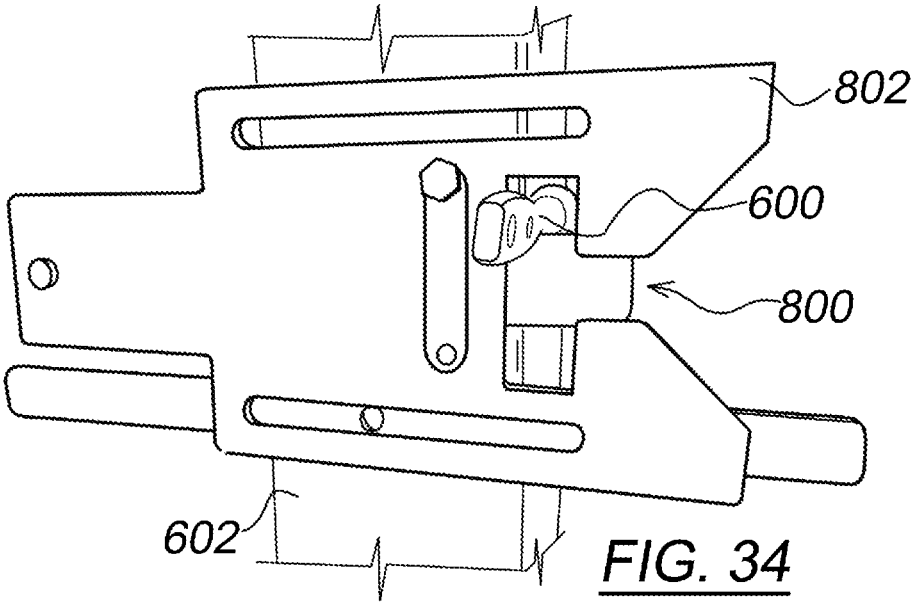
FIG. 34 is a side perspective view showing a sixth embodiment of the gate securing device installed and in a latched condition.

Referring to FIG. 34, a sixth embodiment of the gate securing device is shown. FIG. 34 is a side perspective view showing a sixth embodiment of the gate securing device installed on the gate post 602 for use with a right hand gate and in a latched condition with the striker bar 600. The sixth embodiment includes a locking member assembly 800 and a latching member 802.

Figure 38:
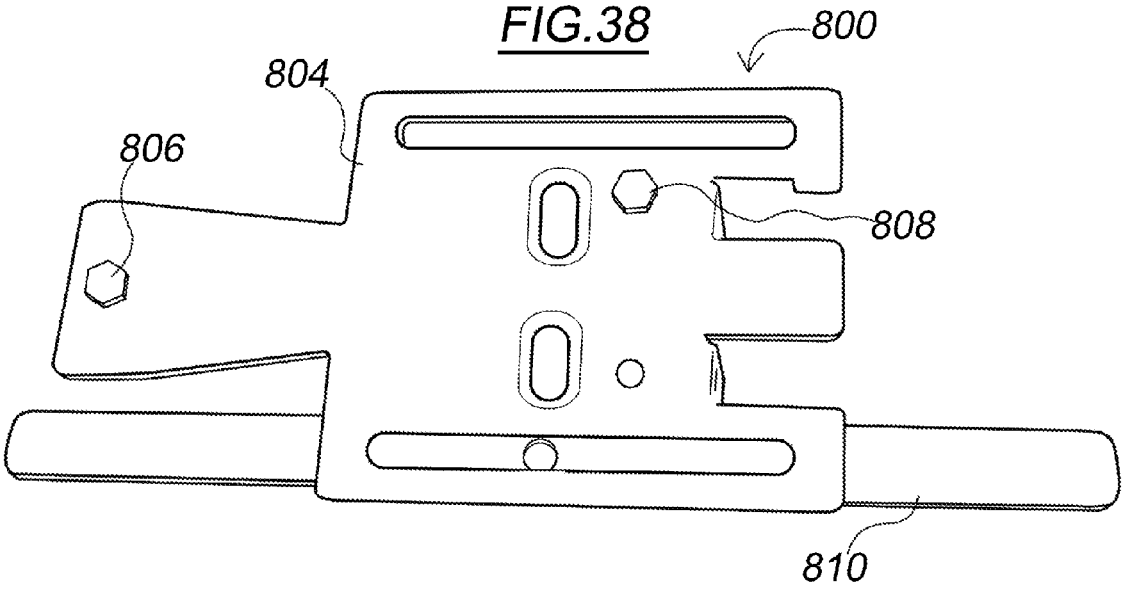
FIG. 38 is a side perspective view showing a locking member assembly of the sixth embodiment of the gate securing device.

Referring to FIG. 38, the locking member assembly 800 includes a locking member 804, a pivot fastener 806, a threaded latching member stop 808 and a lock shuttle 810.

Figure 39:
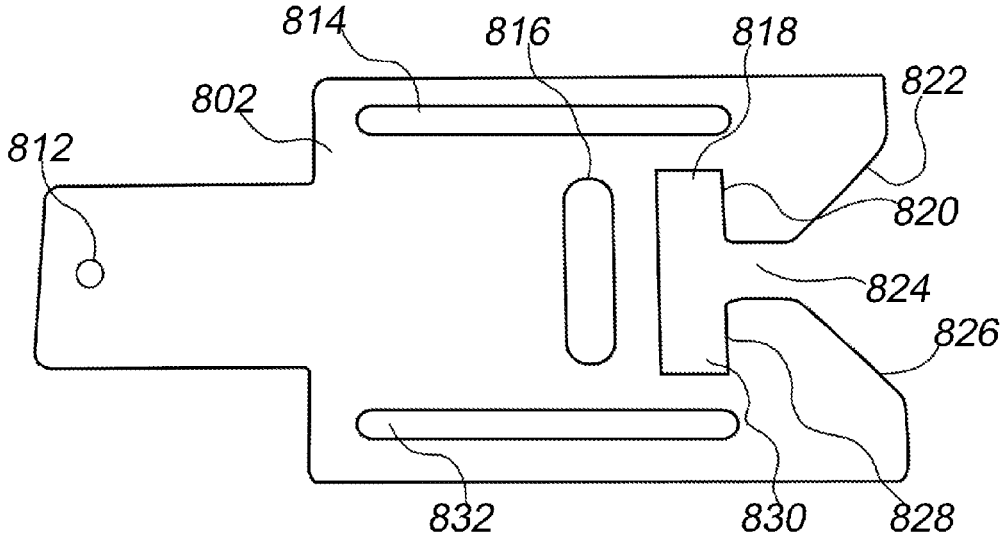
FIG. 39 is a side perspective view showing a latching member of the sixth embodiment of the gate securing device.
Figure 40:
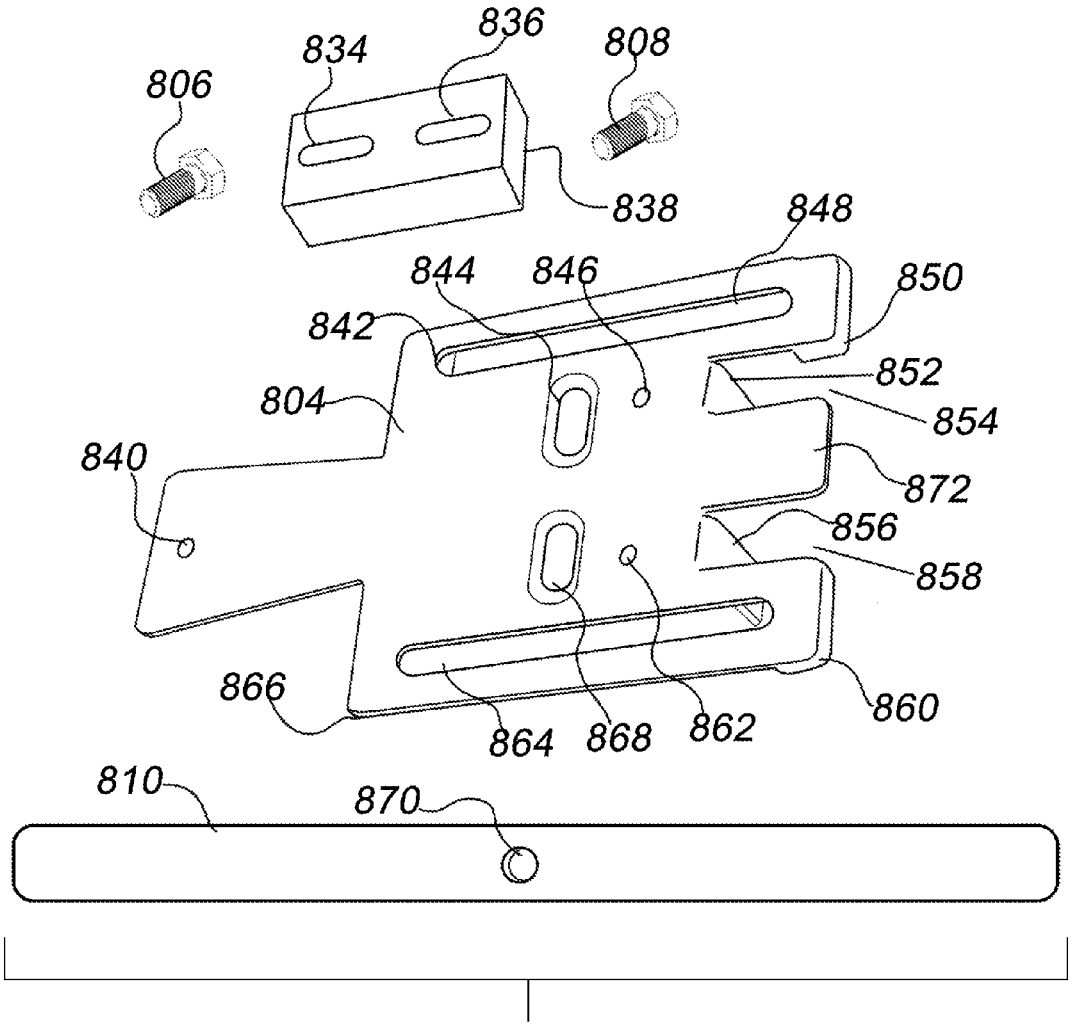
FIG. 40 is a side perspective view showing the of the locking member assembly of the sixth embodiment of the gate securing device.

Referring to FIG. 39, the latching member 802 includes a pivot hole 812 for attachment to the locking member 804, a stop slot 816, a striker bar 600 upper ramp or cam 822 and a striker bar 600 lower ramp or cam 826. The latching member 802 also includes an upper lock slot, elongated lock aperture or lock keeper 814 and a lower lock slot, elongated lock aperture or lock keeper 832 for receiving the hasp of the lock 604. Additionally, the latching member 802 has an upper grapple 820, a lower grapple 828, a striker bar 600 upper open space 818 and a striker bar 600 lower open space 830. The upper grapple 820 and the lower grapple 828 are used to secure the striker bar 600 in a latched state. The stop slot 816 establishes the latching member 802's resting position against threaded stop 808. Moreover, the latching member 802 has a striker bar 600 entrance opening 824 that provides an entrance for the striker bar 600 into open spaces 818 and 830.

The locking member 804 has an upper striker bar 600 opening 854 and a lower striker bar 600 opening 858. The upper striker bar 600 opening 854 and the lower striker bar 600 opening 858 provide an entrance for the striker bar 600. Furthermore, the locking member 804 includes a pivot hole 840 and threaded holes 846 and 862. The hole 840 is used to permanently attach the latching member 802 to the locking member 804 via pivot fastener 806 and pivot hole 812. The threaded holes 846 and 862 are used with stop 808 and stop slot 816 to establish a resting position for the latching member 802. The locking member 804 has slots 844 and 868 for attachment to the post 602 using corresponding slots 834 and 836 of spacer 838 with attachment fasteners not shown. The spacer 838 is used to offset the gate securing device to allow clearance for the lock 604. The upper stop tab 852 and lower stop tab 856 are used for alignment with the post 602. Also, the locking member 804 has an upper lock slot, elongated lock aperture or lock keeper 848 and a lower lock slot, elongated lock aperture or lock keeper 864. The upper lock slot lock keeper 848 corresponds to upper lock slot keeper 814 and the lower lock slot lock keeper 864 corresponds to the lower lock slot lock keeper 832 for securing the latching member 802 to the locking member 804 with the hasp of lock 604. The locking member 804 has a locking projection 872 for retainment of striker bar 600 in association with grapples 820 and 828 when the locking member 804 is locked to the latching member 802. The locking projection 872 can also serve as a rest to support the striker bar 600 which in turn supports the gate.

To facilitate transporting the lock 604 along lock keepers 848, 864, 832 and 814, the lock shuttle 810 is used. The lock shuttle 810 has a lock coupler 870 or other suitable lock shuttle coupler such as a hole for receiving the hasp of the lock 604. The lock shuttle 810 can have different configurations such as a bar or rigid material or a shaped flexible material, each with provisions for installing and removing the lock 604. The locking member 804 has lock shuttle 810 supports 842, 850, 866 and 860 for longitudinal guidance of the lock shuttle 810. The lock shuttle 810 is inserted into supports 860 and 866 or 850 and 842 depending on whether the gate is a left hand or right hand gate.

Figure 35:
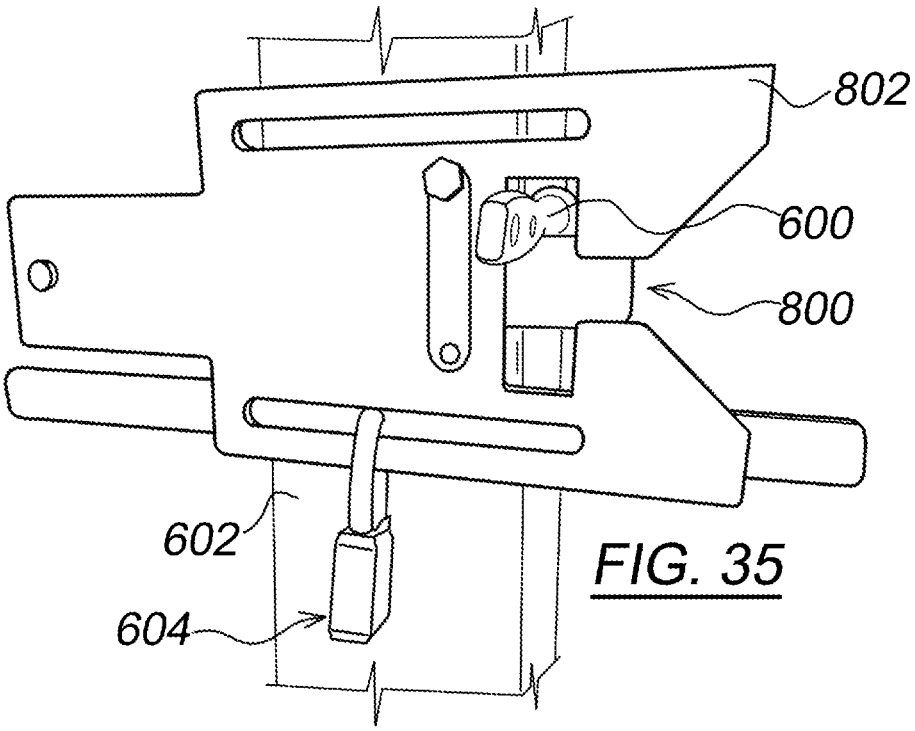
FIG. 35 is a side perspective view showing the sixth embodiment of the gate securing device installed and in a locked condition.
Figure 36:
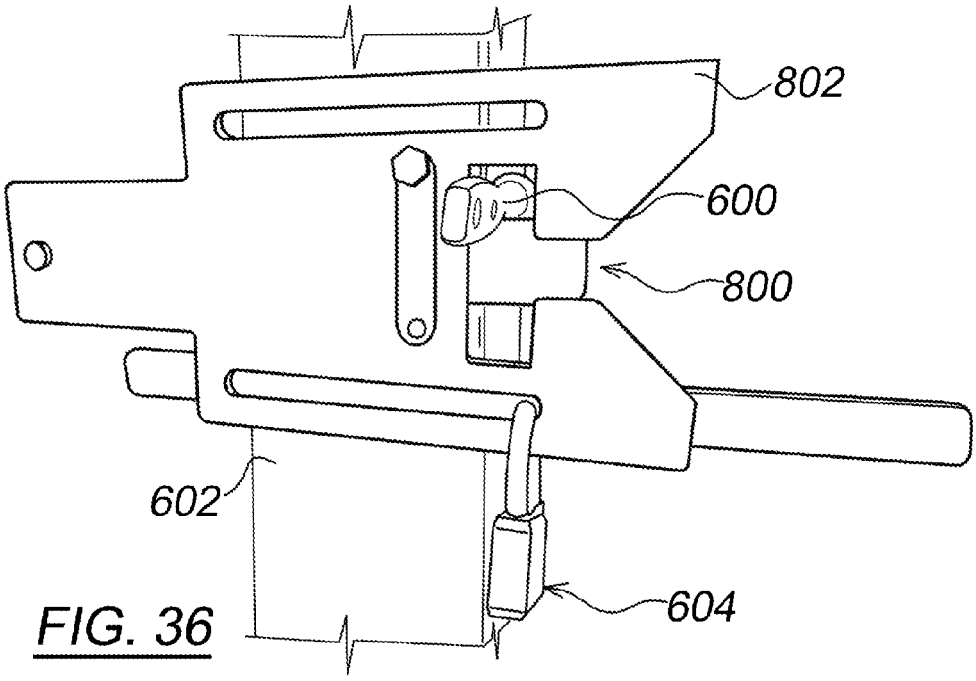
FIG. 36 is a side perspective view showing the sixth embodiment of the gate securing device installed and in a locked condition with the lock slid to the right for operator accessibility to the lock.
Figure 37:
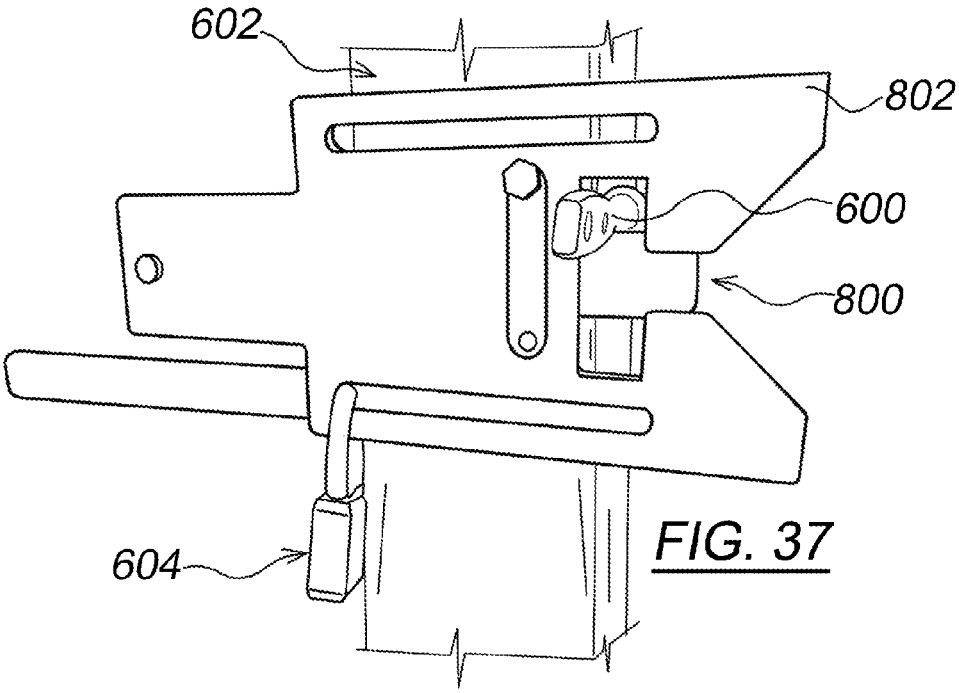
FIG. 37 is a side perspective view showing the sixth embodiment of the gate securing device installed and in a locked condition slid to the left for operator accessibility to the lock.

For security enhancement, note the overlap of the grapple 820 (grapple 828 when used with a left hand gate) and the locking projection 872 when the latching member 802 is locked to locking member assembly 800, similar to that as shown in FIGS. 35, 36 and 37.

As a minimum, the following features and components are used for a right hand gate: 816, 818, 820, 822, 824, 832, 846, 854, 860, 864, 866 and 808.

As a minimum, the following features and components are used for a left hand gate: 814, 816, 824, 826, 828, 830, 842, 848, 850, 858, 862 and 808.

Alternately and as a minimum, the sixth embodiment can include only the latching member 802 and the locking member 804 with fastener 806.

Operation of the Sixth Embodiment—FIG. 34, FIG. 35, FIG. 36 and FIG. 37

FIG. 34, FIG. 35, FIG. 36 and FIG. 37 show an example of the operation of the sixth embodiment applicable to a right hand gate. The operation of the gate securing device includes two sub-operations, namely a latching operation and a locking operation. To perform the latching operation, the following assumptions are made: the gate is open and the operator is on the striker bar 600 side of the gate. Upon closing the gate, the striker bar 600 interacts with cam 822, causing the latching member 802 to rotate counterclockwise, and then enters striker bar 600 entrance opening 824 ending in the striker bar 600 open space 818 as a result of the latching member 802 rotating clockwise due to its inherent gravity bias. The striker bar 600 is now secured by grapple 820 and thereby, resulting in the gate being in a latched state. To open the gate, it is unlatched by applying an upward force to the latching member 802 thereby rotating it counterclockwise. The upward force is applied until the grapple 820 is above the striker bar 600. At this point, the gate is unlatched and can be opened. If the operator is on the side of the gate opposite from the striker bar 600, the gate is latched and unlatched in the same operation as previously stated.

To perform the locking operation, the following assumptions are made: the gate is latched and the operator is on the striker bar 600 side of the gate. To lock the gate, the operator pulls the lock shuttle 810 until the lock coupler 870 is accessible. At this point, the operator inserts the hasp of the lock 604 through the lock coupler 870 and the lock keepers 832 and 864 to lock the gate. The gate is locked because the striker bar 600 is secured since the latching member 802 and the locking member 804 cannot be moved with respect to each other. If the operator is on the side of the gate opposite from the striker bar 600, the gate is locked in the same operation as previously stated.

To unlock the gate, the operator pulls the lock shuttle 810 until the lock 604 is accessible and simply removes the lock 604 so that the latching member 802 and locking member 804 function independently. If the operator is on the side of the gate opposite from the striker bar 600, the gate is unlocked in the same operation as previously stated.

Seventh Embodiment

FIG. 1, FIG. 2, FIG. 3, FIG. 4, FIG. 10, FIG. 11, FIG. 12, FIG. 13, FIG. 17, FIG. 28, FIG. 29, FIG. 30, FIG. 31, FIG. 34, FIG. 35, FIG. 36 and FIG. 37

The seventh embodiment, according to this application, defines a method for use with a striker bar 600 and a lock 604 to secure a gate or other similar article to a gate post 602, that provides for locking and unlocking the gate from each of its sides, the method includes the steps of:

(a) providing a device applicable to the first, second, third, fifth or sixth embodiments;

(b) moving the device at least in part, while accessing either side of the gate, to either position to the operator the lock keepers 134 and 164, 218 and 248, 316 and 338, 718 and 748, or the lock coupler 870, as applicable;

(c) attaching the lock 604 to lock keepers 134 and 164, 218 and 248, 316 and 338, 718 and 748, 814 and 848, or 832 and 864, as applicable, to secure the latching member 102, 202, 302, 702 and 802, as applicable, to the respective locking member 104, 234, 304, 734 and 804, thereby locking the device to the striker bar 600 and thus, the gate to the gate post 602;

(d) moving the device at least in part, while accessing either side of the gate, to position the lock 604 to the operator; and (e) removing the lock 604 from the device to unlock the gate from the gate post 602. whereby, the gate can be locked and unlocked from each side of the gate.

Operation of the Seventh Embodiment

The operation of the seventh embodiment is explained in the DETAILED DESCRIPTION OF THE EMBODIMENTS—Seventh Embodiment, above.

Advantages of the Embodiments

From the descriptions above, a number of possible advantages of the gate securing device controllable from both gate sides and method therefor should become evident.

(a) the device and method have the ability to control gate securing functions of locking and unlocking from both sides of a gate with a single lock;

(b) the device and method have the ability to control gate securing functions of latching and unlatching from both sides of a gate;

(c) the device cannot be removed when gate is in locked condition thus ensuring security;

(e) the device can be installed on both left and right hand gates;

(f) the device provides the capability for self latching;

(g) the device provides provision for an operator supplied lock;

(h) the device provides for gravity biased latching;

(i) the device is inexpensive;

(j) the device is easy to install; and (k) the device is user friendly.

CONCLUSION, RAMIFICATIONS, AND SCOPE

Thus, a person of ordinary skill in the art will understand that the gate securing device fully controllable from each gate side and method therefor may be novel, simple and user friendly and have many advantages, features, and benefits. Furthermore, it will be readily apparent to one skilled in the art that the device and method therefor of this application may be essential for latching, unlatching, locking and unlocking a gate from each side of the gate. In addition, it should be evident that the device and method therefor may provide enhanced gate security since the device cannot be removed when the gate is locked. Moreover, the gate securing device fully controllable from each gate side and method therefor may have one or more of the additional advantages in that:

The device can be installed on both right hand and left hand gates;

The device has embodiments with only two moving parts

The device is inexpensive;

The device and method are simple to use;

The device and method saves time;

The device is reliable;

The device is easy to install; and

The device provides for self latching.

Although the description above contains many specificities, these should not be construed as limiting the scope of the disclosed invention but as merely providing illustrations of some of the embodiments of this invention. Many other ramifications, variations, alterations, substitutions, modifications, and the like are readily possible within the teachings of this invention. For example, sizes, shapes, materials, assembly, design, etc. of all parts can be readily modified or changed.

With respect to the first embodiment, examples for modification or change may be: the handle bracket 116 is included in opening 156 to provide weight for proper gravity biasing however if a spring was used for biasing, the handle bracket 116 could be attached to the locking member 104 in an alternate manner thus eliminating screws 106, 108, 110, 118, 120 and 122, handle attachment plate 114, threaded holes 150, 152, 158, 160, 174, 176, 168, 166, 188, 190, 192, 194, 196 and 198 and a handle attached to the locking member assembly 100 in a simpler manner; the locking tabs 162 and 136 can be eliminated and corresponding lock keepers 164 and 134 placed in the body of the locking member 104 and the latching member 102, respectively; the locking member assembly 100 and the latching member 102 can be permanently affixed to the attachment bracket 502; open spaces 148, 178, 126 and 144 can have alternate configurations; the locking member assembly 100 and the latching member 102 could be spring biased instead of gravity biased; the locking member assembly 100 and the latching member 102 can be attached directly to the post 602 via an attachment bolt/screw through the holes 146 and 124, respectively, thus eliminating the bracket member assembly 500; the locking member assembly 100 and the latching member 102 may be symmetrical by a vertical line passing through holes 146 and 124, respectively, however the locking member assembly 100 and the latching member 102 can be configured asymmetrically by retaining the geometry on one side of the vertical line and replacing the geometry on the opposite side of the vertical line with a configuration to ensure proper gravity bias and with this modification the locking member assembly 100 and the latching member 102 can be installed on the post 602 by reversing the direction of an attachment bolt/screw to holes 146 and 124 to ensure compatibility with left and right hand gates; with reference to "a configuration to ensure proper gravity bias", stated above, the "configuration" can be non-gravity biased if spring biasing is used; the handle attachment screw 112, the locking handle 180 and the hole 182 can be eliminated and replaced with a permanent tab on the handle bracket 116; the first embodiment of the gate securing device can be mounted on a gate with the striker bar 600 mounted on the post 602; and the attachment bracket 502 can include a striker bar 600 rest or support positioned between upper stop tab 506 and lower stop tab 508 which serves to support the striker bar 600 which in turn supports the gate.

With respect to the second embodiment, examples for modification or change may be: the locking tabs 220 and 250 can be eliminated and corresponding lock keepers 218 and 248 placed in the body of the latching member 202 and the locking member 234, respectively; the latching member 202 and the locking member assembly 200 can be permanently affixed to the attachment bracket 502; open spaces 206, 232, 240 and 256 can have alternate configurations; the latching member 202 and the locking member assembly 200 could be spring biased instead of gravity biased; the latching member 202 and the locking member assembly 200 can be attached directly to the post 602 via an attachment bolt/screw through the hole 204 and slot 258, respectively, thus eliminating the bracket member assembly 500; the latching member 202 and the locking member assembly 200 may be symmetrical by a vertical line passing through hole 204 and slot 258, respectively, however the latching member 202 and the locking member assembly 200 can be configured asymmetrically by retaining the geometry on one side of the vertical line and replacing the geometry on the opposite side of the vertical line with a configuration to ensure proper gravity bias and with this modification the latching member 202 and the locking member assembly 200 can be installed on the post 602 by reversing the direction of an attachment bolt/screw to hole 204 and slot 258 to ensure compatibility with left and right hand gates; with reference to "a configuration to ensure proper gravity bias", stated above, the "configuration" can be non-gravity biased if spring biasing is used; the handle attachment screws 236 and 238 locking handles 246 and 252 can be eliminated and replaced with a permanent tab on locking member 234; the second embodiment of the gate securing device can be mounted on a gate with the striker bar 600 mounted on the post 602; and the attachment bracket 502 can include a striker bar 600 rest or support positioned between upper stop tab 506 and lower stop tab 508 which serves to support the striker bar 600 which in turn supports the gate.

With respect to the third embodiment, examples for modification or change may be: the locking tabs 318 and 340 can be eliminated and corresponding lock keepers 316 and 338 placed in the body of the latching member 302 and the locking member 304, respectively; the latching member 302 and the locking member assembly 300 can be permanently affixed to the attachment bracket 502; open spaces 310, 324, 326 and 350 can have alternate configurations; the latching member 302 and the locking member assembly 300 could be spring biased instead of gravity biased; the latching member 302 and the locking member assembly 300 can be attached directly to the post 602 via an attachment bolt/screw through the hole 308 and hole 352, respectively, thus eliminating the bracket member assembly 500; the latching member 302 and the locking member assembly 300 may be symmetrical by a vertical line passing through holes 308 and 352, respectively, however the latching member 302 and the locking member assembly 300 can be configured asymmetrically by retaining the geometry on one side of the vertical line and replacing the geometry on the opposite side of the vertical line with a configuration to ensure proper gravity bias and with this modification the latching member 302 and the locking member assembly 300 can be installed on the post 602 by reversing the direction of an attachment bolt/screw to holes 308 and 352 to ensure compatibility with left and right hand gates; with reference to "a configuration to ensure proper gravity bias", stated above, the "configuration" can be non-gravity biased if spring biasing is used; the third embodiment of the gate securing device can be mounted on a gate with the striker bar 600 mounted on the post 602; and the attachment bracket 502 can include a striker bar 600 rest or support positioned between upper stop tab 506 and lower stop tab 508 which serves to support the striker bar 600 which in turn supports the gate.

With respect to the fourth embodiment, examples for modification or change may be: the latching member 302 and the locking member assembly 400 can be permanently affixed to the attachment bracket 502; open spaces 310, 324, 426 and 450 can have alternate configurations; the latching member 302 and the locking member assembly 400 could be spring biased instead of gravity biased; the latching member 302 and the locking member assembly 400 can be attached directly to the post 602 via an attachment bolt/screw through the hole 308 and slot 452, respectively, thus eliminating the bracket member assembly 500; the latching member 302 and the locking member assembly 400 may be symmetrical by a vertical line passing through holes 308 and 452, respectively, however the latching member 302 and the locking member assembly 400 can be configured asymmetrically by retaining the geometry on one side of the vertical line and replacing the geometry on the opposite side of the vertical line with a configuration to ensure proper gravity bias and with this modification the latching member 302 and the locking member assembly 400 can be installed on the post 602 by reversing the direction of an attachment bolt/screw to holes 308 and 452 to ensure compatibility with left and right hand gates; with reference to "a configuration to ensure proper gravity bias", stated above, the "configuration" can be non-gravity biased if spring biasing is used; the male portion 454M of the locking mechanism assembly 454 can be combination or key activated; the male portion 454M of the locking mechanism assembly 454 can be affixed to the locking tab 318 and oriented downwardly with the keeper 454F being on locking tab 440; locking tabs 318 and 440 can be eliminated and the male portion 454M of the locking mechanism assembly 454 can be affixed to the body of latching member 302 with the male portion 454M oriented inwardly/horizontally with a keeper corresponding to keeper 454F in the body of locking member 404; the fourth embodiment of the gate securing device can be mounted on a gate with the striker bar 600 mounted on the post 602; and the attachment bracket 502 can include a striker bar 600 rest or support positioned between upper stop tab 506 and lower stop tab 508 which serves to support the striker bar 600 which in turn supports the gate.

With respect to the fifth embodiment, examples for modification or change may be: the locking tabs 720 and 750 can be eliminated and corresponding keepers 718 and 748 placed in the body of the latching member 702 and the locking member 734, respectively; open spaces 732 and 756 can have alternate configurations; the latching member 702 and the locking member 734 could be spring biased instead of gravity biased; the latching member 702 and the locking member 734 can be attached directly to the post 602 via an attachment bolt/screw through the hole 704 and hole 758, respectively, thus eliminating the bracket member assembly 500; open space 732, grapple 726 and cam 730 on latching member 702 and grapple 754 and open space 756 on locking member 734 can be rotated 90 degrees counterclockwise so that they may be substantially on the top of latching member 702 and locking member 734 for compatibility with vertically sliding structures such as gates, doors, windows, panels and other similar sliding objects that use a striker bar 600; the fifth embodiment of the gate securing device can be mounted on a gate with the striker bar 600 mounted on the gate 602; and the attachment bracket 502 can include a striker bar 600 rest or support positioned between upper stop tab 506 and lower stop tab 508 which serves to support the striker bar 600 which in turn supports the gate.

With respect to the sixth embodiment, examples for modification or change may be: open spaces 818 and 830 and openings 854 and 858 can have alternate configurations; the latching member 802 and the locking member 804 may be symmetrical by a horizontal line passing through holes 812 and 840, respectively, however the latching member 802 and the locking member assembly 800 can be configured asymmetrically by retaining the geometry on one side of the horizontal line and replacing the geometry on the opposite side of the horizontal line with a simple configuration and with this modification the latching member 802 will require spring biasing if the applicable grapple operates from below the striker bar 600; and the gate securing device of the sixth embodiment can be mounted on a gate with the striker bar 600 mounted on the post 602.

Figure 41:
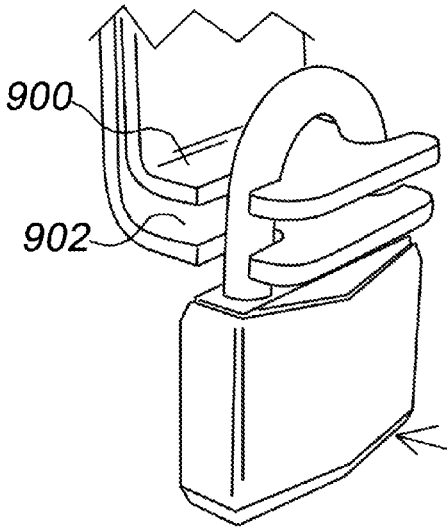
FIG. 41 is a side perspective view showing a first alternate version of lock keepers.
Figure 42:
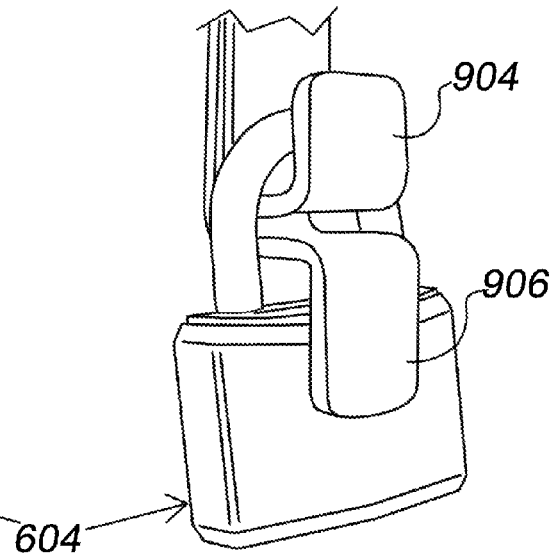
FIG. 42 is a side perspective view showing a second alternate version of lock keepers.

Referring to FIG. 41, a side perspective view of a first alternate version of lock keepers is shown. Lock keeper 900 and lock keeper 902 can be used to respectively replace lock keepers previously shown on the locking member and latching member applicable to the first, second, third, fifth and seventh embodiments. Referring to FIG. 42, a side perspective view of a second alternate version of lock keepers is shown. Lock keeper 904 and lock keeper 906 can be used to respectively replace lock keepers previously shown on the locking member and latching member applicable to the first, second, third, fifth and seventh embodiments.

Lock keepers are more generically defined as any configuration of latching and locking member structure by which a respective latching member and locking member can be secured together with a removable lock.

Accordingly, the scope and meaning should be determined not only by the embodiments illustrated, but by the appended claims and their legal equivalents.

We claim:

1. A device for engaging a striker bar positioned on an object, such as a panel, gate, door or other similar article, to secure the object to a structure adjacent the object, the object and the structure, when secured together, generally defining a plane in space with first and second sides, the device being equally operable from each side of the defined plane, the device comprising:

a latching member and a locking member each moveable with respect to the other, and each pivotally mounted to said structure about a common axis, the locking member further being slidable on the common axis, said latching member further comprising:

a leading edge cam oriented to contact the striker bar and thereby direct the pivoting rotation of the latching member;

a first grapple for pivotally engaging the striker bar to establish a latched state between the object and the adjacent structure; and at least a first part of a multipart locking assembly, said multipart locking assembly serving to lock said members together with or without a separate lock device, said locking member further comprising:

a second grapple for slidingly engaging the striker bar to establish the latched state between the object and the adjacent structure by captively positioning the striker bar between the first and second grapples; and at least a second part of the multipart locking assembly;

wherein said members, in combination, secure the device to the striker bar when said members are locked together, thereby securing the object to the adjacent structure for establishment of the locked state, and wherein the device is pivotally rotatable about the common axis to alternately position the first and second parts of said multipart locking assembly together on one side or the other of the defined plane.

2. The device as defined in claim 1 wherein said members each further comprise biasing elements to pivotally rotate each member to a centered position whereby the multipart locking assembly is centered between each side of the defined plane; and wherein the device including the multipart locking assembly is accessible from either side of the defined plane.

3. The device as defined in claim 1 wherein the device further comprises a plurality of operating handle structures, at least one of said plurality extending towards each side of the defined plane, and permitting the rotation of the device to position the multipart locking assembly so as to be accessible from both sides of the defined plane.

4. The device as defined in claim 1 wherein:

each of said members further comprises a left hand side and a right hand side separated by a vertical axis extending orthogonal to and through the common (pivoting) axis, the device therefore generally having vertical symmetry;

wherein said sides are substantially mirrored with respect to each other to provide device compatibility with both left hand and right hand swinging objects.

5. The device as defined in claim 1 wherein at least said latching member is one of gravity or spring biased.

6. The device as defined in claim 1 wherein said latching member and said locking member are pivotally mounted to one of the object or the structure with a fastener.

7. The device as defined in claim 1 wherein said locking member further defines a mounting slot for allowing said locking member to be slidable on the common axis, vertically displacing said locking member with respect to said latching member.

8. The device as defined in claim 1 further comprising an attachment bracket secured to the structure and wherein said members are pivotally mounted to said attachment bracket at said common axis.

9. The device as defined in claim 8 wherein said attachment bracket and said members are positioned so that said members generally cover said bracket such that it cannot be removed during said locked state.

10. A device for use with a striker bar to secure an object, the object having two sides, to an adjacent structure, the device being equally operable from each side of the object, the device comprising:

a latching member and a locking member each rotatable with respect to the other, and each pivotally mounted with the other on a common axis, the locking member further being slidable on the common axis, both members positioned on one of the structure or the object, with the striker bar being positioned on the other one of the structure or the object, said latching member further comprising:

a leading edge cam oriented to contact the striker bar and thereby direct the pivoting rotation of the latching member;

a grapple for pivotally engaging the striker bar to establish a latched state between the object and the adjacent structure; and a first lock keeper, the first lock keeper in combination with a second lock keeper on said locking member forming a locking mechanism for locking said members together, said locking member further comprising:

a closure portion for slidingly engaging the striker bar to establish the latched state between the object and the adjacent structure by captively positioning the striker bar between the grapple and the closure portion: and a second lock keeper;

a first positioning member operable to move one or more of said first and second lock keepers and said locking mechanism to either side of the object when the device is in an unlatched state; and a second positioning member operable to move all of said first and second lock keepers, said locking mechanism, and an ancillary attached lock device to either side of the object when the device is in an latched state; and wherein said grapple of said latching member and said closure portion of said locking member, in combination, secure the device to the striker bar when said members are locked together, thereby securing the object to the adjacent structure for establishment of the locked state, and wherein the device pivotally rotatable about the common axis to alternately position said first lock keeper, said second lock keeper, and said locking mechanism on either side of the object.

11. The device as defined in claim 10 wherein:

said closure portion of said locking member comprises a second grapple, said members each further comprise biasing elements to pivotally rotate each member to a centered position whereby the first and second lock keepers and the locking mechanism are centered between each side of the object;

wherein the device including the locking mechanism is accessible from either side of the object.

12. The device as defined in claim 10 wherein:

each of said members further comprises a left hand side and a right hand side separated by a vertical axis extending orthogonal to and through the common (pivoting) axis, the device therefore generally having vertical symmetry;

wherein said sides are substantially mirrored with respect to each other to provide device compatibility with both left hand and right hand swinging objects.

13. The device as defined in claim 10 wherein at least said latching member is one of gravity or spring biased.

14. The device as defined in claim 10 wherein said latching member and said locking member can be pivotally mounted to one of the object or the structure with a fastener.

15. The device as defined in claim 10 wherein said locking member further defines a mounting slot for allowing said locking member to be slidable on the common axis, vertically displacing said locking member with respect to said latching member.

16. The device as defined in claim 10 further comprising an attachment bracket secured to one of the object or the structure and wherein said members are pivotally mounted to said attachment bracket at said common axis.

17. The device as defined in claim 16 wherein said attachment bracket and said members are positioned so that said members generally cover said bracket such that it cannot be removed during said locked state.

* * * * *